US009148729B2

(12) United States Patent
Josefsson

(10) Patent No.: US 9,148,729 B2
(45) Date of Patent: Sep. 29, 2015

(54) MICROPHONE WITH PROGRAMMABLE FREQUENCY RESPONSE

(71) Applicant: Invensense, Inc., San Jose, CA (US)

(72) Inventor: Olafur Mar Josefsson, Hafnarfjordur (IS)

(73) Assignee: INVENSENCE, INC., San Jose, CA (US)

( * ) Notice: Subject to any disclaimer, the term of this patent is extended or adjusted under 35 U.S.C. 154(b) by 456 days.

(21) Appl. No.: 13/626,532

(22) Filed: Sep. 25, 2012

(65) Prior Publication Data

US 2014/0086433 A1 Mar. 27, 2014

(51) Int. Cl.

| | |
|---|---|
| ***H04R 3/00*** | (2006.01) |
| ***H04R 19/00*** | (2006.01) |
| *H04R 3/06* | (2006.01) |
| *H04R 19/01* | (2006.01) |

(52) U.S. Cl.

CPC ..... *H04R 19/005* (2013.01); *H04R 3/06* (2013.01); *H04R 19/016* (2013.01)

(58) Field of Classification Search

CPC ..... H04R 3/00; H04R 23/004; H04R 19/04
USPC ..... 381/91–92, 111, 113, 98
See application file for complete search history.

(56) References Cited

U.S. PATENT DOCUMENTS

| | | | | |
|---|---|---|---|---|
| 6,795,374 | B2 | 9/2004 | Barnes et al. | 367/138 |
| 7,634,096 | B2 | 12/2009 | Fallesen | 381/113 |
| 7,683,815 | B2 | 3/2010 | Josefsson et al. | 341/143 |
| 2008/0089536 | A1 | 4/2008 | Josefsson | 381/113 |
| 2008/0090625 | A1 | 4/2008 | Josefsson et al. | 455/575.1 |
| 2010/0246859 | A1 | 9/2010 | David et al. | 381/120 |
| 2010/0310096 | A1* | 12/2010 | Josefsson et al. | 381/113 |
| 2011/0142261 | A1 | 6/2011 | Josefsson | 381/107 |
| 2013/0044898 | A1* | 2/2013 | Schultz et al. | 381/111 |
| 2013/0051582 | A1* | 2/2013 | Kropfitsch et al. | 381/111 |
| 2013/0230183 | A1* | 9/2013 | Eriksson et al. | 381/66 |

OTHER PUBLICATIONS

Burwen, Richard S. "A Low-Noise High-Output Capacitor Microphone System", Journal of the Audio engineering Society, vol. 25, pp. 278-283, May 1997.

Spinelli, Enrique Mario "On the Stability of Shield-Driver Circuits", IEEE Transactions on Instrumentation and Measurement, vol. 59, No. 2, pp. 458-462, Feb. 2010.

* cited by examiner

*Primary Examiner* — Disler Paul

(74) *Attorney, Agent, or Firm* — Maryam Imam; IPxLaw Group LLP

(57) ABSTRACT

Methods and apparatus automatically cancel or attenuate an unwanted signal (such as low frequencies from wind buffets) from, and/or control frequency response of, a condenser microphone, or control the effective condenser microphone sensitivity before the signal reaches an ASIC or other processing circuit. As a result, the maximum amplitude signal seen by the processing circuit is limited, thereby preventing overloading the input of the processing circuit. Remaining (wanted) frequencies can be appropriately amplified to reduce the noise burden on further processing circuits. A corrective signal is applied to a bias terminal of the condenser microphone to cancel the unwanted signal. Optionally or alternatively, a controllable impedance is connected to a line that carries the signal generated by the MEMS microphone, so as to attenuate unwanted portions of the signal.

46 Claims, 17 Drawing Sheets

MICROPHONE WITH PROGRAMMABLE FREQUENCY RESPONSE

TECHNICAL FIELD

The present invention relates to capacitor microphones, and more particularly to condenser microphones with programmable frequency response.

BACKGROUND ART

Condenser microphones are commonly used in mobile telephones and other consumer electronic devices, embedded systems and other devices. Condenser microphones include microelectromechanical systems (MEMS) microphones, electret condenser microphones (ECMs) and other capacitor-based transducers of acoustic signals. A MEMS microphone element typically includes a conductive micromachined diaphragm that vibrates in response to an acoustic signal. The microphone element also includes a fixed conductive plate parallel to, and spaced apart from, the diaphragm. The diaphragm and the conductive plate collectively form a capacitor. An electrical charge is placed on the capacitor, typically by an associated circuit. The capacitance of the capacitor varies rapidly as the distance between the diaphragm and the plate varies due to the vibration of the diaphragm. Typically, the charge on the capacitor remains essentially constant during these vibrations, so the voltage across the capacitor varies as the capacitance varies. The varying voltage may be used to drive a circuit, such as an amplifier or an analog-to-digital converter, to which the MEMS microphone element is connected. A MEMS microphone element connected to a circuit is referred to herein as a "MEMS microphone system" or a "MEMS system."

MEMS microphone dies are often electrically connected to application-specific integrated circuits (ASICs) to process the electrical signals from the microphone elements. A MEMS microphone die and its corresponding ASIC are often housed in a common integrated circuit package to keep leads between the microphone element and the ASIC as short as possible, so as to avoid parasitic capacitance caused by long leads, because capacitance coupled to the signal line attenuates the signal from the MEMS microphone element.

When used in consumer electronics devices and other contexts, condenser microphone systems may be subjected to widely varying amplitudes of acoustic signals. For example, a mobile telephone used outdoors under windy conditions or in a subway station subjects the condenser microphone to very loud acoustic signals. Under these circumstances, the diaphragm may reach its absolute displacement limit, and the resulting signal may therefore be "clipped," causing undesirable distortion. Even if the diaphragm does not reach its absolute displacement limit, the ASIC or other processing circuitry may not be able to handle peaks in the electrical signal from the condenser microphone element due to limited voltage available from a power supply, and the signal may, therefore, be clipped. Clipping can cause a loss of signal contents. For example, if a speech signal is clipped, the output signal waveform becomes flat and no longer varies with the human speech.

U.S. patent application Ser. No. 12/962,136, titled "MEMS Microphone with Programmable Sensitivity," filed Dec. 7, 2010 (U.S. Pat. Publ. No. 2011/0142261) and U.S. patent application Ser. No. 12/784,143, titled "Switchable Attenuation Circuit for MEMS Microphone System," filed May 20, 2010 (U.S. Pat. Publ. No. 2010/0310096) disclose circuits for attenuating signals from MEMS microphones.

U.S. Pat. No. 7,634,096, titled "Amplifier Circuit for Capacitive Transducers," issued Dec. 15, 2009 (U.S. Pat. Publ. No. 2005/0151589) notes a power-on problem in prior art capacitive transducer systems and an associated lack of ability to withstand high-level acoustical signals, such as low-frequency transients generated by door slams or mechanical shocks, etc. The '096 patent discloses a servo-controlled bias circuit for a capacitive transducer, which is said to improve settling of an amplifier circuit coupled to the transducer. The servo-controlled circuit is said to resolve traditionally competing requirements of maintaining a large input resistance of the amplifier circuit to optimize its noise performance and providing fast settling of the amplifier circuit.

Richard S. Burwen, "A Low-Noise High-Output Capacitor Microphone System," Journal of the Audio Engineering Society, May 1977, Volume 25, Number 5, pages 278-283, describes a capacitor microphone system designed to increase maximum acoustic input capability by including a manual switch to select one of several possible sound pressure levels (SPLs). An amount of feedback within the system is user selectable.

However, the prior art does not disclose or suggest any circuits for automatically selectively attenuating unwanted signals, such as wind buffets.

SUMMARY OF EMBODIMENTS

An embodiment of the present invention provides a microphone system. The microphone system includes a transducer, a first circuit and a second circuit. The transducer includes a vibratable structure configured to establish a capacitance that varies in accordance with an acoustic signal received by the transducer. The first circuit has an input coupled to the transducer to receive, via the input, an electrical signal that varies in accordance with the variable capacitance of the transducer. The first circuit has an output and is configured to process the received electrical signal and provide a corresponding processed electrical signal at the output. The second circuit is coupled to the input of the first circuit and to a node downstream of the output of the first circuit. The second circuit is configured to automatically detect when a signal from the downstream node meets a predetermined criterion and, in response, effectively couple an impedance to the input of the first circuit in response. The impedance is configured to attenuate the electrical signal received at the input of the first circuit.

The predetermined criterion may include a frequency-dependent criterion. The predetermined criterion may include an amplitude-dependent criterion.

The impedance may include a capacitor.

The predetermined criterion may include a frequency-dependent criterion. The impedance may include a capacitor. The capacitor includes first and second terminals. The first terminal of the capacitor may be coupled to the input of the first circuit. The second circuit may include a filter coupled between the downstream node and the second terminal of the capacitor.

The second circuit may include a buffer. The filter and the buffer may be collectively coupled between the downstream node and the second terminal of the capacitor, so as to provide a filtered and buffered version of the signal from the downstream node to the second terminal of the capacitor.

The filter may include a high-pass filter, so as to provide a high-pass filtered and buffered version of the signal from the downstream node to the second terminal of the capacitor.

The filter may include a digital signal processor. The buffer may include a digital-to-analog converter.

The buffer may be configured to provide a gain having an absolute value greater than 1.

The impedance may include a resistor. The resistor may include a switched capacitor or an array of switched capacitors.

The second circuit may be configured to effectively remove the impedance from the input of the first circuit in response to automatic detection that the signal from the downstream node does not meet the predetermined criterion.

The second circuit may be configured to effectively couple the impedance to the input of the first circuit at approximately a zero crossing of the electrical signal received at the input of the first circuit.

The predetermined criterion may be met if the signal from the downstream node contains a predetermined frequency above a predetermined energy level or a frequency component above a predetermined energy level, below a predetermined frequency.

The predetermined criterion may be met if total energy in a predefined bandwidth of the signal from the downstream node exceeds a predetermined level.

The predetermined criterion may be met if total energy of the signal from the downstream node exceeds a predetermined level.

The predetermined criterion may be met if the signal from the downstream node contains a predetermined frequency component having at least a predetermined amplitude.

The predetermined criterion may be automatically adjusted.

The predetermined criterion may be adjustable in response to a user input.

The transducer may include a MEMS microphone.

The MEMS microphone, the first circuit and the second circuit may be disposed within a single integrated circuit housing.

The microphone system may also include a bias circuit coupled to the transducer and a third circuit. The third circuit may be configured to automatically generate a corrective signal in response to detection that the electrical signal that varies in accordance with the variable capacitance of the transducer meets a second predetermined criterion. The third circuit may be configured to apply the corrective signal to the bias circuit, such that the corrective signal cancels an unwanted portion of the electrical signal that varies in accordance with the variable capacitance of the transducer.

The MEMS microphone, the bias circuit, the first circuit, the second circuit and the third circuit may be disposed within a single integrated circuit housing.

Another embodiment of the present invention provides a method for automatically attenuating an electrical signal from a transducer. The transducer includes a vibratable structure configured to establish a capacitance that varies in accordance with an acoustic signal received by the transducer. A first circuit has an input coupled to the transducer to receive, via the input, an electrical signal that varies in accordance with the variable capacitance of the transducer. The first circuit has an output and is configured to process the received electrical signal and provide a corresponding processed electrical signal at the output. The method includes receiving a signal from a node downstream of the output of the first circuit and automatically detecting if the signal from the downstream node meets a predetermined criterion. If the signal from the downstream node meets the predetermined criterion, an impedance is automatically effectively coupled to the input of the first circuit. The impedance is configured to attenuate the electrical signal received at the input of the first circuit.

Detecting if the signal from the downstream node meets the predetermined criterion may include automatically detecting if the signal from the downstream node meets a frequency-dependent criterion.

Detecting if the signal from the downstream node meets the predetermined criterion may include automatically detecting if the signal from the downstream node meets an amplitude-dependent criterion.

Effectively coupling the impedance may include coupling a capacitor to the input of the first circuit.

Automatically detecting if the signal from the downstream node meets the predetermined criterion may include filtering the signal received from the node downstream of the first circuit to generate a filtered signal. Effectively coupling the impedance to the input of the first circuit may include coupling a first terminal of a capacitor to the input of the first circuit and applying the filtered signal to a second terminal of the capacitor.

Automatically detecting if the signal from the downstream node meets the predetermined criterion may include filtering and buffering the signal received from the node downstream of the first circuit to generate a filtered buffered signal. Effectively coupling the impedance to the input of the first circuit may include coupling a first terminal of a capacitor to the input of the first circuit and applying the filtered buffered signal to a second terminal of the capacitor.

Effectively coupling the impedance to the input of the first circuit may include effectively coupling a resistor to the input of the first circuit.

The resistor may include a switched capacitor or an array of switched capacitors.

If the signal from the downstream node does not meet the predetermined criterion, the impedance may be automatically effectively removed from the input of the first circuit.

Automatically detecting if the signal from the downstream node meets the predetermined criterion may include automatically detecting if the signal from the downstream node contains a predetermined frequency.

Automatically detecting if the signal from the downstream node meets the predetermined criterion may include automatically detecting if the signal from the downstream node contains a frequency component below a predetermined frequency.

Automatically detecting if the signal from the downstream node meets the predetermined criterion may include automatically detecting if the signal from the downstream node contains a predetermined frequency component having at least a predetermined amplitude.

The method may also include automatically adjusting the predetermined criterion or adjusting the predetermined criterion in response to a user input.

Yet another embodiment of the present invention provides a microphone system that includes a transducer, a bias circuit, a first circuit and a second circuit. The transducer includes first and second terminals and a vibratable structure configured to establish a capacitance that varies in accordance with an acoustic signal received by the transducer. The variable capacitance is detectable between the first and second terminals. The bias circuit is coupled to the second terminal of the transducer. The first circuit has an input coupled to the first terminal of the transducer to receive, via the input, an electrical signal that varies in accordance with the variable capacitance of the transducer. The first circuit has an output and is configured to process the received electrical signal and provide a corresponding processed electrical signal at the output. The second circuit is configured to automatically generate a corrective signal in response to detection that the electrical signal that varies in accordance with the variable capacitance of the transducer meets a predetermined criterion. The second circuit is also configured to apply the corrective signal to the bias circuit, such that the corrective signal cancels an unwanted portion of the electrical signal that varies in accordance with the variable capacitance of the transducer.

The second circuit may include a filter and an amplifier. The second circuit may be configured to generate the corrective signal as a low-pass filtered and inverted version of the electrical signal that varies in accordance with the variable capacitance of the transducer.

The filter may include a digital signal processor. The amplifier may include a digital-to-analog converter.

The predetermined criterion may be met if the signal from the electrical signal that varies in accordance with the variable capacitance of the transducer contains more than a predetermined amount of energy within a predetermined frequency range.

The predetermined criterion may be automatically adjusted.

The predetermined criterion may be adjustable in response to a user input.

The transducer may include a MEMS microphone.

The MEMS microphone, the bias circuit, the first circuit and the second circuit may be disposed within a single integrated circuit housing.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Figure 1:
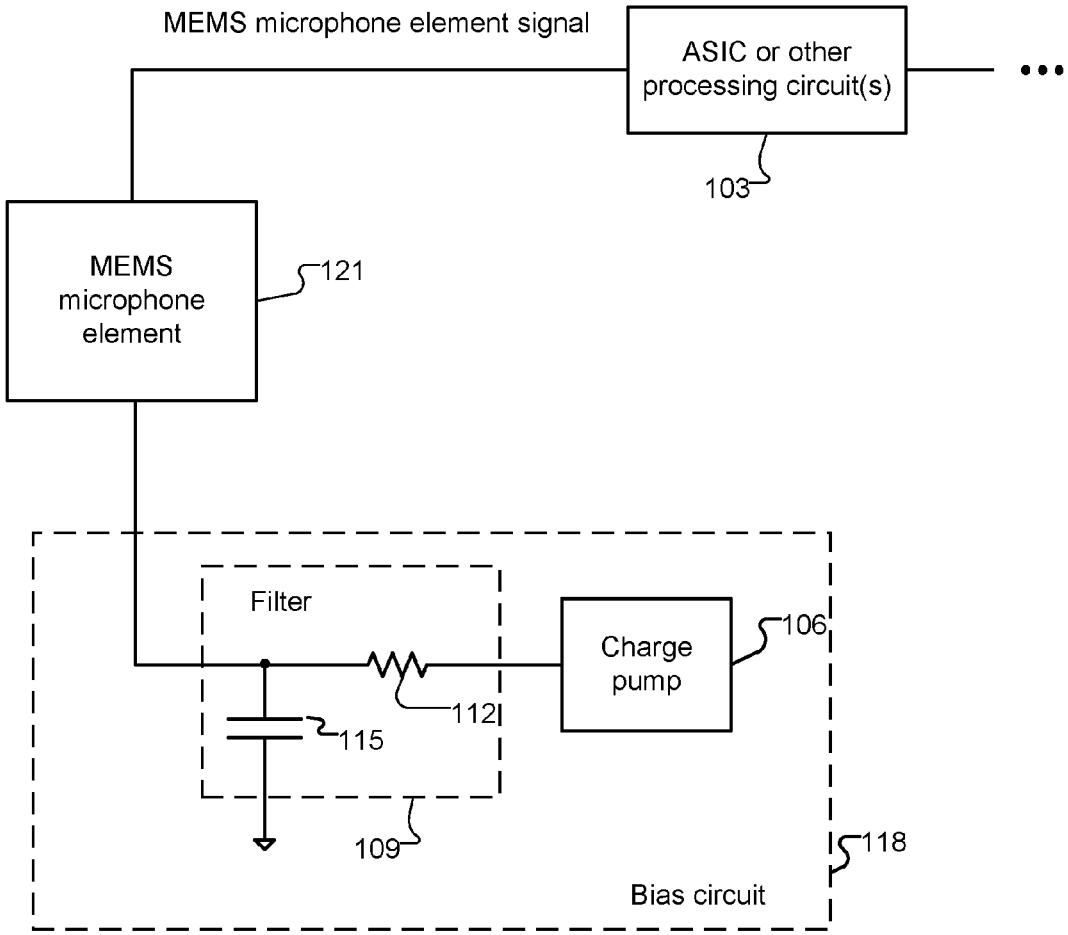
(Prior Art) FIG. 1
FIG. 1 is a schematic block diagram of a MEMS microphone system, according to the prior art.

In accordance with embodiments of the present invention, methods and apparatus are disclosed for automatically cancelling or attenuating a signal from, and/or controlling frequency response of, a condenser microphone. Examples of condenser microphones include MEMS microphones and electret condenser microphones (ECMs). In some embodiments, unwanted high-energy frequencies, such as low frequencies (such as below about 200 Hz) from wind buffets, are automatically cancelled or attenuated before a signal from a condenser microphone element reaches an ASIC or other processing circuit (a "subsequent processing circuit"). As a result, the maximum amplitude signal seen by the processing circuit is limited, thereby preventing overloading the input of the subsequent processing circuit. The remaining (wanted) frequencies can be appropriately amplified to reduce the noise burden on further subsequent processing circuits.

Other applications include: shaping frequency response of a condenser microphone element, thereby correcting a nonideal frequency response of the condenser microphone element or a subsequent circuit; extending effective bandwidth of a condenser microphone element or subsequent circuit; correcting for an undesirable resonant frequency peak of a condenser microphone element; and tailoring a wide frequency response condenser microphone element to a specific application. For example, a wide-band condenser transducer element may be made relatively insensitive to audio frequencies, such as 20 Hz to 20 kHz, and responsive to only ultrasounds, such as above 20 kHz. Such a configuration avoids overloading, or even processing, subsequent processing circuits with audio frequencies which, in this case, are not of interest. Most embodiments are described in relation to MEMS microphones. However, ECMs or other condenser microphones or other condenser transducers of acoustic signals may be used in most cases. MEMS microphones typically require bias circuits. However, ECMs typically have permanent charges and, therefore, do not require bias circuits, as is well known in the art.

Two basic approaches are disclosed. In one approach, a corrective signal is applied to a terminal of a condenser microphone other than the signal-generating terminal of the microphone. For example, the corrective signal may be applied to a terminal of a MEMS microphone element, through which charge is applied to the MEMS microphone element. The corrective signal cancels an unwanted portion of the signal generated by the condenser microphone element. In the other approach, an impedance is connected to a line that carries the signal generated by a condenser microphone element, so as to attenuate unwanted portions of the signal from the condenser microphone element. The effective impedance is controlled by a corrective signal.

In either case, the corrective signal may be generated from the signal from the condenser microphone element or from a circuit downstream from the condenser microphone element (collectively referred to herein as "a signal from the condenser microphone element"). The corrective signal may, for example, be generated by appropriately filtering, amplifying (with or without gain), inverting, digitally processing and/or otherwise processing the signal from the condenser microphone element. However, the corrective signal may be generated differently for the two approaches. Both approaches are described in detail, below.

FIG. 1 is a schematic block diagram of a MEMS microphone system, according to the prior art. One terminal of a MEMS microphone element 100 is connected to an ASIC or other signal processing circuit 103. A charge pump 106 is connected to the other terminal of the MEMS microphone element 100. The charge pump 106 includes a filter 109 or is coupled to the MEMS microphone element 100 via the filter 109. The filter 109 is realized by a large impedance (shown as a resistor 112) and a filter capacitor 115. Collectively, the charge pump 106 and the filter 109 form a bias circuit 118.

Apply Corrective Signal to Non-Signal Terminal of Condenser Microphone

Figure 2:
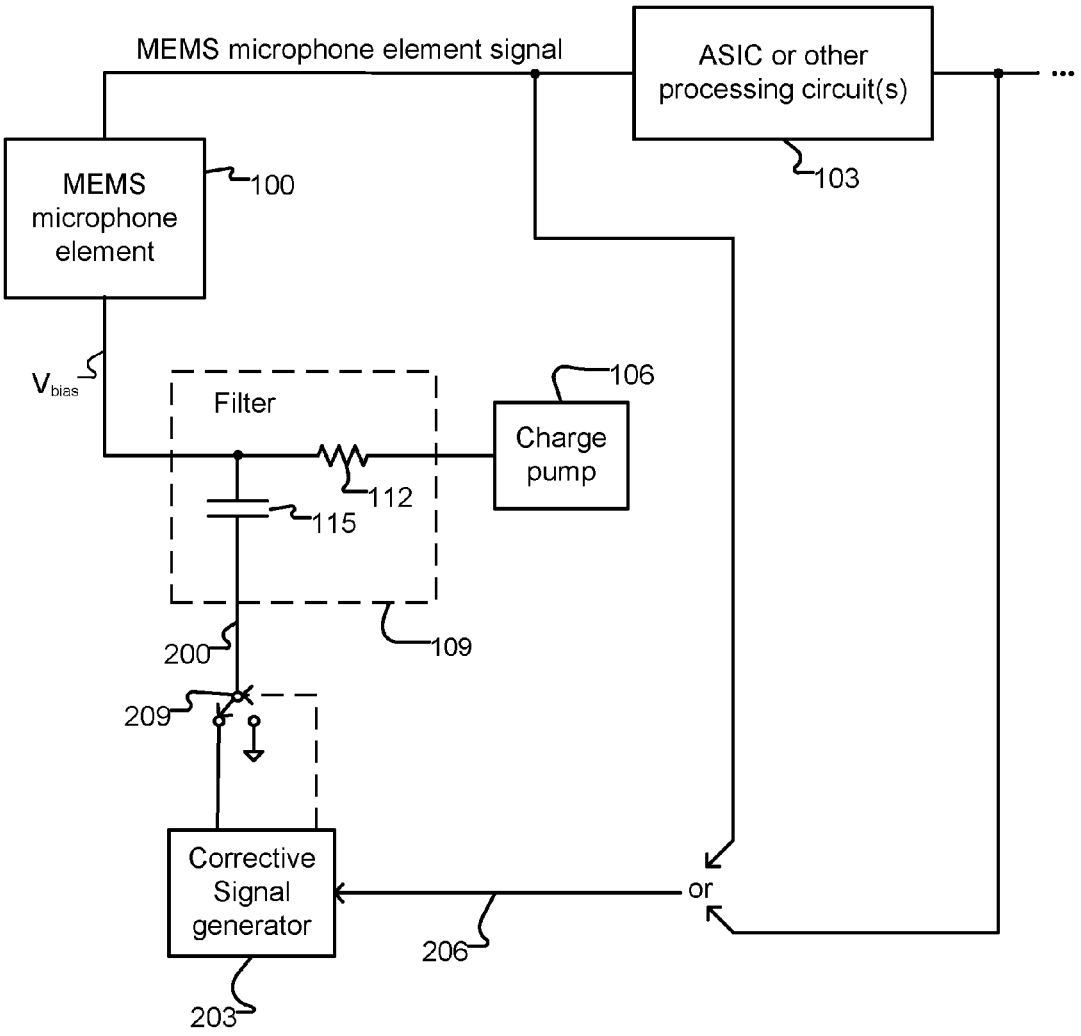
FIG. 2 is a schematic block diagram of a MEMS microphone system, according to an approach provided by the present invention.

As noted, one inventive approach involves generating a corrective signal to cancel or attenuate unwanted portions of a signal from a condenser microphone element and applying the corrective signal to a non-signal terminal of the condenser microphone. This approach is summarized in a schematic block diagram in FIG. 2, using a MEMS microphone as a non-limiting example. Conventionally, values of the impedance 112 and capacitor 115 of the filter 109 are selected such that the filter corner is only about a few Hz or even lower, i.e., less than about 1 Hz, so as to filter out as much noise from the charge pump 106 as possible. Consequently, the impedance at audio frequencies of the capacitor 115 is small, compared to the impedance of the resistor 112 at audio frequencies. A corrective AC signal 200 in the audio frequency range can, therefore, drive the terminal of the capacitor 115 that would otherwise be grounded, and this corrective signal appears essentially unattenuated or only marginally attenuated at the $V_{bias}$ terminal of the MEMS microphone element 100. The corrective signal is essentially subtracted from the signal generated by the MEMS microphone element 100.

An ECM or other condenser-based transducer that does not require a bias circuit typically has two terminals: a signal output terminal and another terminal against which the output signal is referenced. Often, the other terminal is grounded, at least to an AC ground. This other terminal is referred to herein as a "non-signal terminal." If an ECM or other such condenser-based transducer is used (not shown), the corrective AC signal 200 may be applied to the non-signal terminal of the ECM or other such condenser-based transducer, either directly or via another component. As used herein, "non-signal terminal" includes the terminal of a MEMS microphone to which bias is applied.

A corrective signal generator 203 generates the corrective signal 200, based on a signal 206 from the MEMS microphone element 100. In some embodiments, the corrective signal 200 is a low-pass filtered and inverted version of the signal from the MEMS microphone element 100. Such a corrective signal 200 cancels an unwanted (low frequency) portion of the signal generated by the MEMS microphone element 100. Appropriate filtering of the MEMS microphone signal enables cancellation of any unwanted frequency, frequencies or ranges of frequencies. Similarly, thresholds on the signal from the MEMS microphone element 100 may be set, so as to cancel only signals that exceed predetermined amplitudes.

Optionally, a switch 209 may be interposed between the corrective signal generator 203 and the terminal of the capacitor 115 that would otherwise be grounded. The switch 209 may be controlled by a circuit within the corrective signal generator 203 or another circuit that monitors the signal 206 from the MEMS microphone element 100. When the corrective signal 200 is not needed, the switch 209 may be thrown to connect the terminal of the capacitor 115 to ground.

This approach and several embodiments are described in more detail, below.

Connect Controlled Impedance to Signal Line from Condenser Microphone

The other inventive approach involves connecting a controlled impedance to a line that carries a signal generated by a condenser microphone element, so as to attenuate unwanted portions of the signal from the condenser microphone element. This approach is summarized in a schematic block diagram in FIG. 3. In the embodiment shown in FIG. 3, the controlled impedance is implemented with a capacitor $C_D$, although other implementations are possible. One terminal of the capacitor $C_D$ is coupled to the line carrying the signal from the condenser microphone element 300. The capacitor $C_D$ forms part of a capacitive divider network that attenuates the condenser microphone element signal. The amount of attenuation depends, at least in part, on the effective value of the capacitor $C_D$.

A corrective signal 301 may be applied to the other terminal of the capacitor $C_D$ to control the effective value of the capacitor $C_D$. For example, if equal voltages are applied to both terminals of the capacitor $C_D$, the capacitor $C_D$ is effectively removed from the circuit, and the signal from the condenser microphone element 300 is not attenuated. On the other hand, if unequal voltages are applied to the two terminals of the capacitor $C_D$, the capacitor's effective value depends on capacitor's actual value and on the applied voltages. Thus, the amount of attenuation depends on the value of the capacitor $C_D$ and on the corrective signal 301.

In some embodiments, the corrective signal 301 is a buffered, high-pass filtered version of the condenser microphone element signal. Thus, the effective value of $C_D$ and, therefore, the attenuation can be made to depend on the frequency of the condenser microphone element signal. For example, when (wanted) high frequencies are present in the condenser microphone signal, the corrective signal 301 has higher amplitude and, therefore, the corrective signal 301 reduces the effective value of the capacitor $C_D$, thereby reducing the amount of attenuation. However, the high-pass filtering prevents or limits (unwanted) low frequencies from contributing to the corrective signal 301 and, therefore, prevents reducing the effective value of the capacitor $C_D$. Consequently, the unwanted low frequencies are attenuated, whereas the wanted high frequencies are not attenuated.

In some embodiments, the corrective signal is an amplified, with gain>1, inverted version of the condenser microphone element signal, which enhances the attenuation caused by the capacitor $C_D$. Using gains greater than 1 and inverting (equivalent to gains less than −1) the signal facilitates use of smaller capacitors, which occupy smaller amounts of real estate on integrated circuits.

Some embodiments dynamically and automatically control the filtering and/or amplification (gain). Some embodiments dynamically and automatically disconnect the capacitor $C_D$ from the line when no frequency-dependent attenuation is needed. Thus, the attenuation can be dynamically controlled.

Some embodiments, the corrective signal is not filtered. In these embodiments, the corrective signal depends only on amplitude, not on frequency components, of the version of the condenser microphone element signal. Thus, the effective value of $C_D$ and, therefore, the attenuation can be made to depend on the amplitude of the condenser microphone element signal. For example, when only low amplitude signals are present in the condenser microphone signal, the corrective signal 301 reduces the effective value of the capacitor $C_D$, thereby reducing, possibly to zero, the amount of attenuation. However, when high amplitude signals are present in the condenser microphone signal, the corrective signal 301 increases the effective value of the capacitor $C_D$, thereby increasing the amount of attenuation. Such embodiments may be used to automatically attenuate the condenser microphone element signal in case of loud sounds, such as door slams, before the condenser microphone element signal reaches the ASCI or other processing circuit 103, thereby preventing clipping or other undesirable consequences of overwhelming the processing circuit 103.

MEMS Microphone Model

Although embodiments of the present invention may be used with any capacitor microphone or other capacitor-based transducer, for simplicity of explanation, the following descriptions are given largely in the contexts of MEMS microphones. As noted, a MEMS microphone is, essentially, a capacitor whose value varies according to an acoustic signal. An electrical charge is placed on one side of the capacitor, typically by a bias circuit. On the other hand, an electret condenser microphone has a permanently charged diaphragm and does not require a bias circuit. In either case, the charge remains essentially unchanged as the capacitance varies with the acoustic signal. Consequently, the voltage across the microphone varies according to the acoustic signal.

Figure 4:
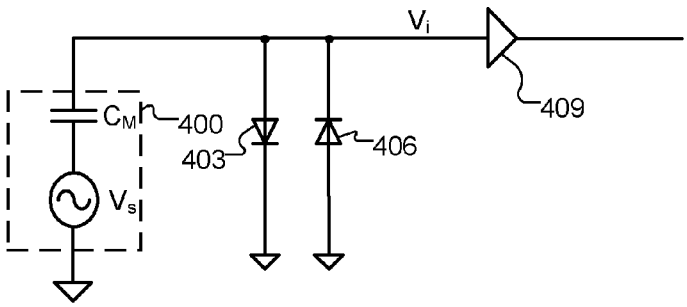
(Prior Art) FIG. 4
FIG. 4 is a schematic circuit diagram of a model of a MEMS microphone, according to the prior art.

A biased MEMS microphone may be modeled, as shown in FIG. 4, as a signal generator $V_S$ in series with a capacitor $C_M$, where the signal generator generates a voltage that varies according to the acoustic signal, and $C_M$ represents the capacitance of the MEMS microphone. Thus, dashed box 400 identifies the modeled MEMS microphone element. Anti-parallel diodes 403 and 406 (and any necessary resistors) provide a high-impedance path to ground from the MEMS microphone element 400 to facilitate applying the bias. As noted, FIG. 4 illustrates a model of a biased MEMS microphone 400, therefore no bias circuit is shown. However, the MEMS microphone 400 may be coupled to an appropriate ground via the bias circuit.

A signal $V_i$ is seen on signal line 413 as being generated by the MEMS microphone element 400. $V_i$ is approximately equal to $V_S$, up to about several hundred millivolts. Above several hundred millivolts, the diodes 403 and 406 begin to conduct and, therefore, clip the signal $V_i$. Diodes 403 and 406 are omitted from most subsequent schematics for simplicity of explanation.

Since the amplitude of the signal $V_i$ is quite low, a buffer 409 is typically coupled to the MEMS microphone element 400. Gain of the buffer 409 is assumed to be 1; however buffers (amplifiers) with other gains may be used. In addition, the buffer 409 may be part of, or replaced by, a more complex circuit (not shown) that processes the signal $V_i$. The signal processing circuit may, for example, include a single-ended or differential amplifier, one or more stages of amplification, an analog-to-digital converter (ADC), a digital signal processor (DSP), etc. Often, the signal processing circuit is implemented as an application specific integrated circuit (ASIC), and often the MEMS microphone and the ASIC are housed in a common IC package.

Implementation: Corrective Signal to Non-Signal Terminal of Condenser Microphone As noted, this approach uses a corrective signal to cancel unwanted portions of a signal from a condenser microphone element. Essentially, the corrective signal is subtracted from the signal generated by the condenser microphone element. The corrective signal is applied in a negative feedback loop from the condenser microphone element signal to the non-signal terminal of the condenser microphone element.

Figure 5:
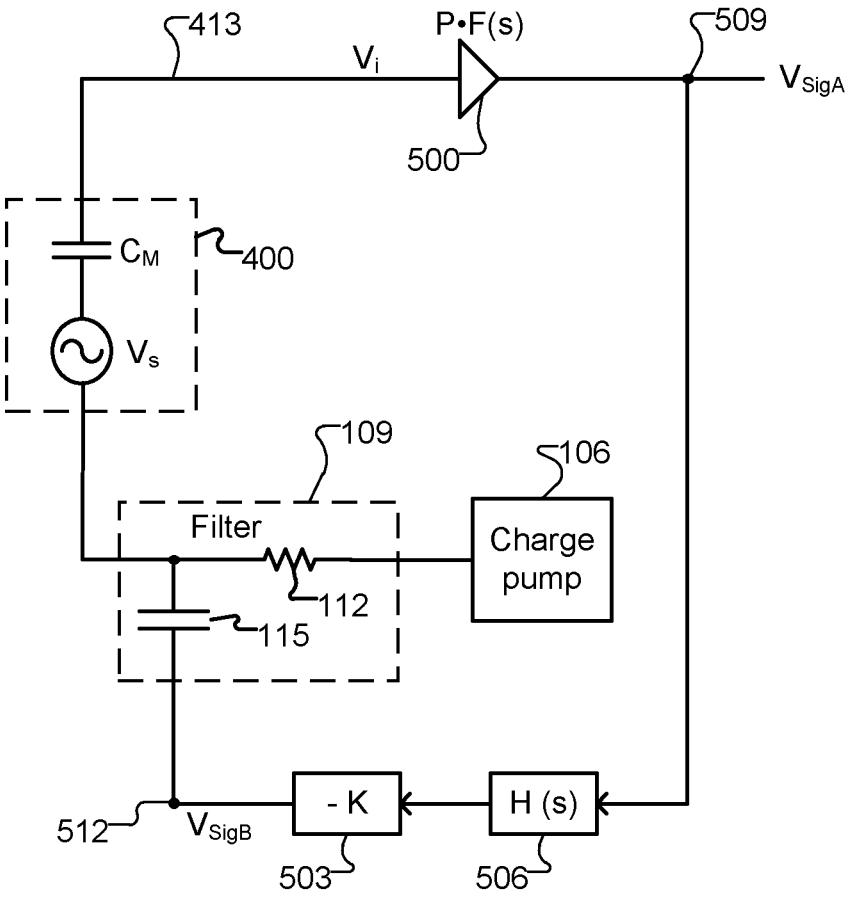
FIG. 5 is a schematic circuit diagram of a MEMS microphone system, with a negative feedback circuit coupled thereto, according to an embodiment of the present invention.

FIG. 5 is a schematic circuit diagram of one such embodiment. The signal $V_i$ seen on signal line 413 as being generated by a MEMS microphone element 100 is fed to a buffer/amplifier 500. Although in many cases the buffer/amplifier 500 merely buffers the signal $V_i$, i.e., the buffer/amplifier 500 has a gain of 1 and does not significantly filter the signal in other cases the buffer/amplifier 500 may provide a gain other than 1 and/or it may filter the signal $V_i$. Thus, to be general, the buffer/amplifier 500 is shown having a gain P and implementing a filter function F(s). Consequently, the buffer/amplifier 500 has a transfer function P·F(s). It should be noted that the buffer/amplifier 500 may be implemented by, or represent, several circuit components.

A version of the output of the buffer/amplifier 500 is fed back to the biased terminal of the MEMS microphone element 100. This feedback loop may include various signal processing elements, which are generalized by amplifier 503, which has a gain of −K, and a filter 506, which has a filter function H(s). The amplifier 503 and the filter 506 may be implemented by separate components, or they may be implemented by a common component or set of components. Instead of, or in addition to, a non-unity gain −K provided by the amplifier 503, a portion of the gain required in the feedback loop may be provided by the gain P of the buffer/amplifier 500. Similarly, a buffer/amplifier 500 that provides differential outputs may be used, such as with the inverting output providing the feedback signal. In such a case, the amplifier 503 need not have a negative gain.

The output of the feedback loop, i.e., the corrective signal, $V_{sigB}$, is applied to the terminal of the capacitor 115 that would otherwise be grounded. Although the feedback signal is shown originating at a single node 509 downstream of the buffer/amplifier 500, the feedback signal may originate at more than one node (not shown). That is, several signals may be combined, with appropriate filtration and/or amplification, to form the corrective signal $V_{sigB}$. Downstream processing of the signal from the MEMS microphone element 100 may include analog and/or digital circuits. Thus, the feedback signal may originate with analog and/or digital signals. Any of the buffer/amplifier 500, the amplifier 503 or the filter 506 may include analog and/or digital components. As noted, the frequency or frequencies of the corrective signal $V_{sigB}$ are passed by the capacitor 115.

Transfer functions of the circuit of FIG. 5 are described by equations (1), (2) and (3).

$$V_{SigA} = \frac{P \cdot F(s)}{1 + K \cdot P \cdot F(s) \cdot H(s)} \cdot V_s \tag{1}$$

$$V_{SigB} = \frac{-K \cdot P \cdot F(s) \cdot H(s)}{1 + K \cdot P \cdot F(s) \cdot H(s)} \cdot V_s \tag{2}$$

$$V_i = \frac{1}{1 + K \cdot P \cdot F(s) \cdot H(s)} \cdot V_s \tag{3}$$

The signal $V_{sigA}$ or $V_{sigB}$ or some combination of the two signals may be taken as the output of the circuit of FIG. 5.

The effective frequency response of the MEMS microphone element 100 may be shaped by appropriate specification of H(s) and F(s). However, in the special case where H(s)=1 and F(s)=1, no frequency shaping is implemented. Instead, the signal 413 is merely attenuated. In this special case, the transfer functions are as shown in equations (4), (5) and (6).

$$V_{SigA} = \frac{P}{1 + K \cdot P} \cdot V_s \tag{4}$$

$$V_{SigB} = \frac{-K \cdot P}{1 + K \cdot P} \cdot V_s \tag{5}$$

$$V_i = \frac{1}{1 + K \cdot P} \cdot V_s \tag{6}$$

Thus, to attenuate the signal from the MEMS microphone element 100 that appears at the input to the buffer/amplifier 500 (such as to prevent overloading the input), K·P should be much larger than 1. If so, $V_{sigA}$ becomes $V_S/K$ and, interestingly, $V_{sigB}$ becomes equal to $-V_S$ (i.e., inverted $V_S$). Thus, if large signal swings are automatically detected at $V_{sigA}$, the constants K and P may be automatically adjusted to attenuate the signal $V_i$ at the input of the buffer/amplifier 500, without changing the amplitude of the signal $V_{sigB}$ $V_{sigA}$ may be either attenuated or gained up, depending on whether K>1 or K<1. This maintains the signal at the input of the buffer/amplifier 500 (where overloading is to be avoided) at a manageable level, without impacting the amplitude of the output signal, if the output is taken at $V_{sigB}$.

Figure 25:
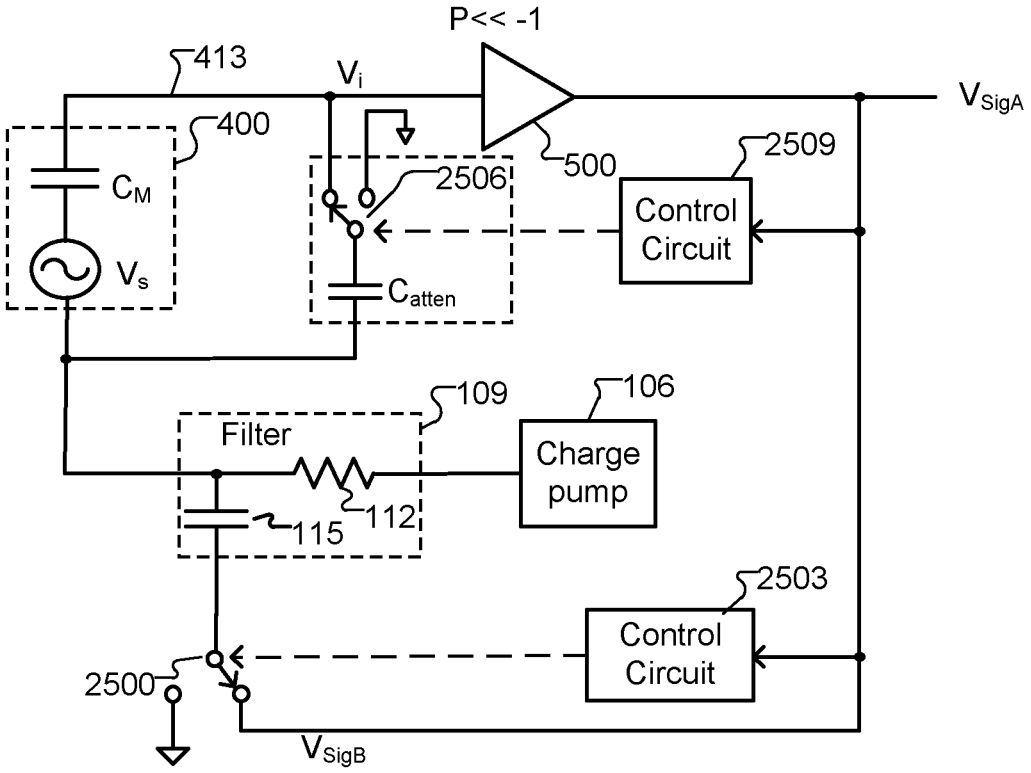
FIG. 25 is a schematic circuit diagram that combines two approaches to signal attenuation, according to an embodiment of the present invention.

The approach of feeding a signal ($V_{sigB}$) back to the bias terminal of the MEMS microphone 100 to prevent overloading the buffer 500 (or biasing diodes connected to 413) ceases to be effective when the amplifier 503 runs out of headroom, such as if the supply voltage to the amplifier 503 is insufficient to generate a sufficiently large $V_{sigB}$ in response to a large acoustic signal. At this point, clipping can be avoided by switching in a capacitance $C_{atten}$, as shown in FIG. 25. A switch 2500 is controlled by a control circuit 2503. If the signal $V_{sigA}$ has too great amplitude or contains unwanted frequency components, the control circuit 2503 couples the signal $V_{sigA}$ to the filter capacitor 115, thereby canceling a portion of the signal from the MEMS microphone 400. However, if the cancellation is insufficient, a second control circuit 2509 operates a second switch 2506 to couple the capacitance $C_{atten}$ to the signal line 413, thereby attenuating the signal 413.

Essentially, this approach combines the two approaches describe above, i.e., applying a corrective signal to the non-signal terminal of the condenser microphone and connecting an impedance to the line that carries the signal generated by the condenser microphone. Once this is done, $V_{sigA}$ and $V_{sigB}$ are reduced in amplitude. However, if desired, this signal attenuation may be compensated digitally, such as by an ADC located downstream from the MEMS element 100. Note that switching in the capacitor $C_{atten}$ may be done without reference to the frequency of the signal from the condenser microphone. In other words, if the signal from the condenser microphone become too great in amplitude (ex., the signal threatens to overwhelm the buffer 500), the capacitor $C_{atten}$ is used to attenuate the signal from the MEMS microphone 400.

Two special subcases, due to their implementation simplicity, are P<0 and 0<−K≤1. A negative K may be implemented with an impedance divider, such as a resistive or capacitive impedance divider. A case in which K=1 is depicted in FIG. 25.

Returning to FIG. 5, in the special case where H(s)=1, F(s)=1 and P=1, $V_{sigA}$ becomes $V_S/(1+K)$. Therefore, varying K effectively changes the sensitivity of the MEMS microphone system for all frequencies. Of course, K could be less than 1.

When no frequency shaping, attenuation or gain is needed, the feedback circuit shown in FIG. 5 may be automatically disconnected from the capacitor 115 at node 512, and the capacitor 115 may be connected to ground instead of to the feedback circuit. Connecting or disconnecting the feedback circuit to the capacitor 115 should be performed at or near zero crossings of the signal from the MEMS microphone element.

Figure 6:
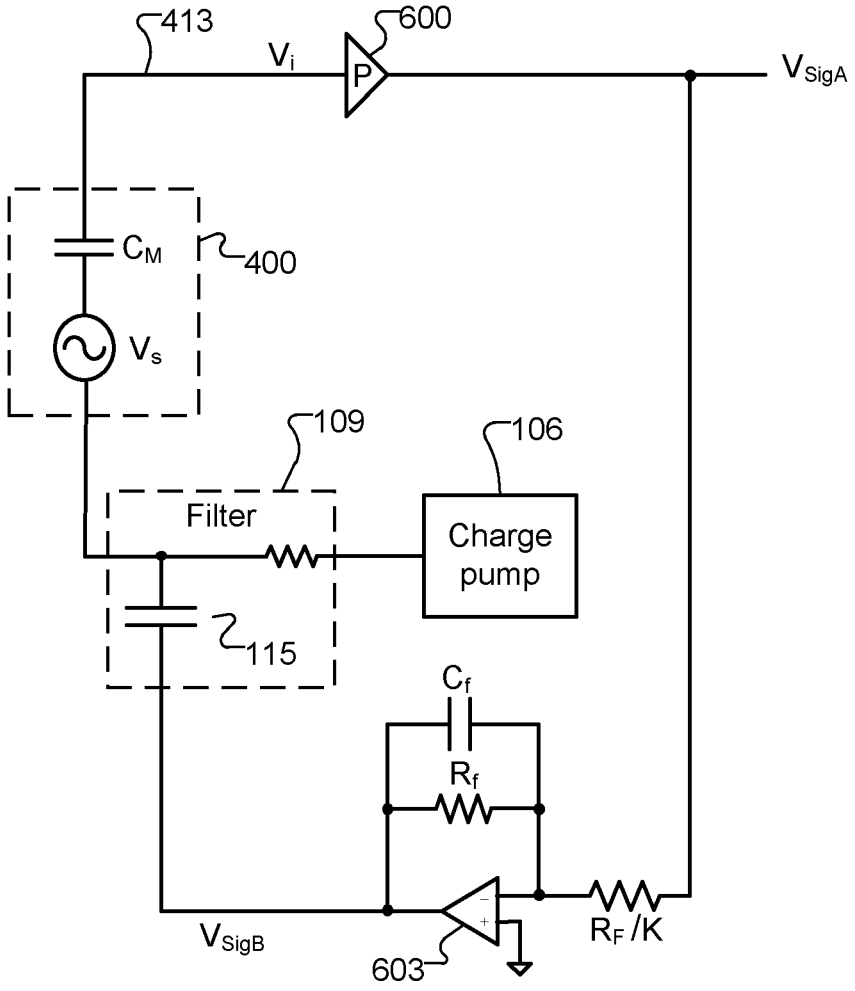
FIG. 6 is a schematic circuit diagram of a MEMS microphone system, with a negative feedback circuit coupled thereto, according to another embodiment of the present invention.

FIG. 6 contains a schematic circuit diagram of an exemplary embodiment that includes a low-pass filter in the feedback loop. A buffer 600 has a gain of P, F(s)=1 and an amplifier 603 and surrounding circuitry provides a gain of K. The transfer function of the feedback loop is as shown in equation (7).

$$H(s) = \frac{1}{1 + S \cdot R_f \cdot C_f} \tag{7}$$

Figure 7:
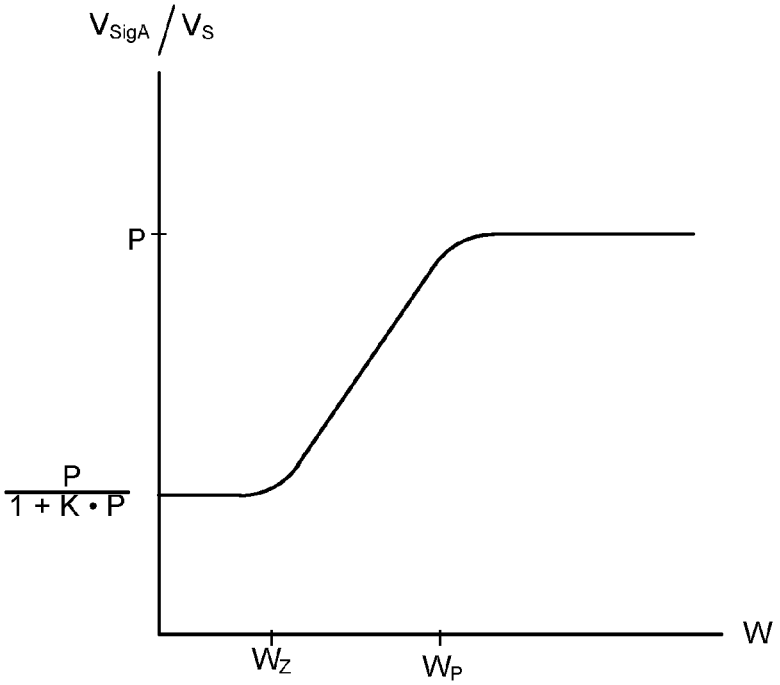
FIGS. 7 and 8 are plots of transfer functions of the circuit of FIG. 6.

The transfer function of $V_{SigA}$, which is a high-pass filter function, is as shown in equation (8) and in a plot in FIG. 7.

$$V_{SigA} = \frac{P \cdot (1 + S \cdot R_f \cdot C_f)}{1 + K \cdot P + S \cdot R_f \cdot C_f} \cdot V_s \tag{8}$$

where $$W_p : \text{Pole} : S = \frac{1 + K \cdot P}{R_f \cdot C_f} \tag{9}$$

$$W_z : \text{Zero} : S = \frac{1}{R_f \cdot C_f} \tag{10}$$

In cases where passing high-frequency signals unchanged and attenuating low-frequency signals is desirable, such as to attenuate wind buffet sounds, P may be set to 1 and K may be set to a value greater than 1. On the other hand, in cases where low-frequency signals should be unchanged and high-frequency signals should be amplified, P may be set to a value much greater than 1 and K may be set to 1.

Figure 8:
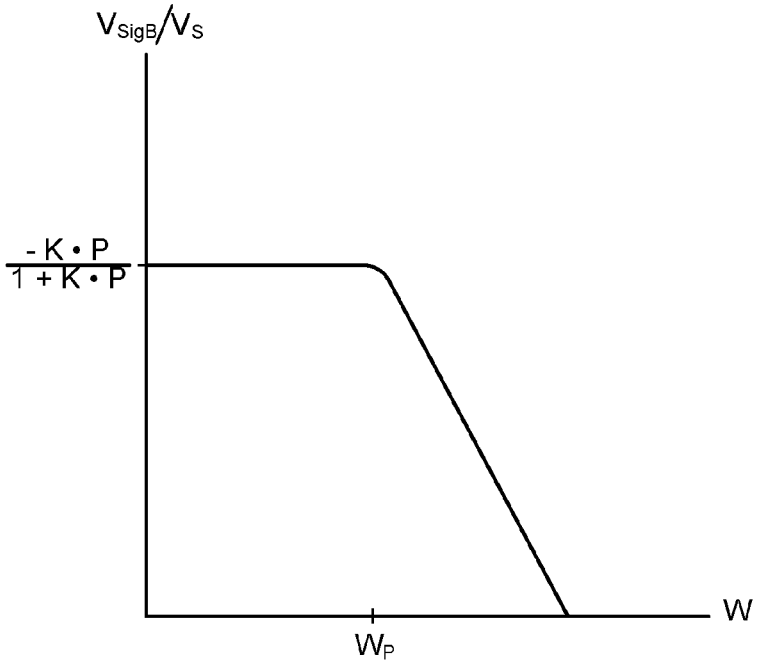

The transfer function of $V_{SigB}$, which is a low-pass filter function, is as shown in equation (11) and in a plot in FIG. 8.

$$V_{SigB} = \frac{-K \cdot P}{1 + K \cdot P + S \cdot R_f \cdot C_f} \cdot V_s \tag{11}$$

where $$W_p : \text{Pole} : S = \frac{1 + K \cdot P}{R_f \cdot C_f} \tag{12}$$

Figure 9:
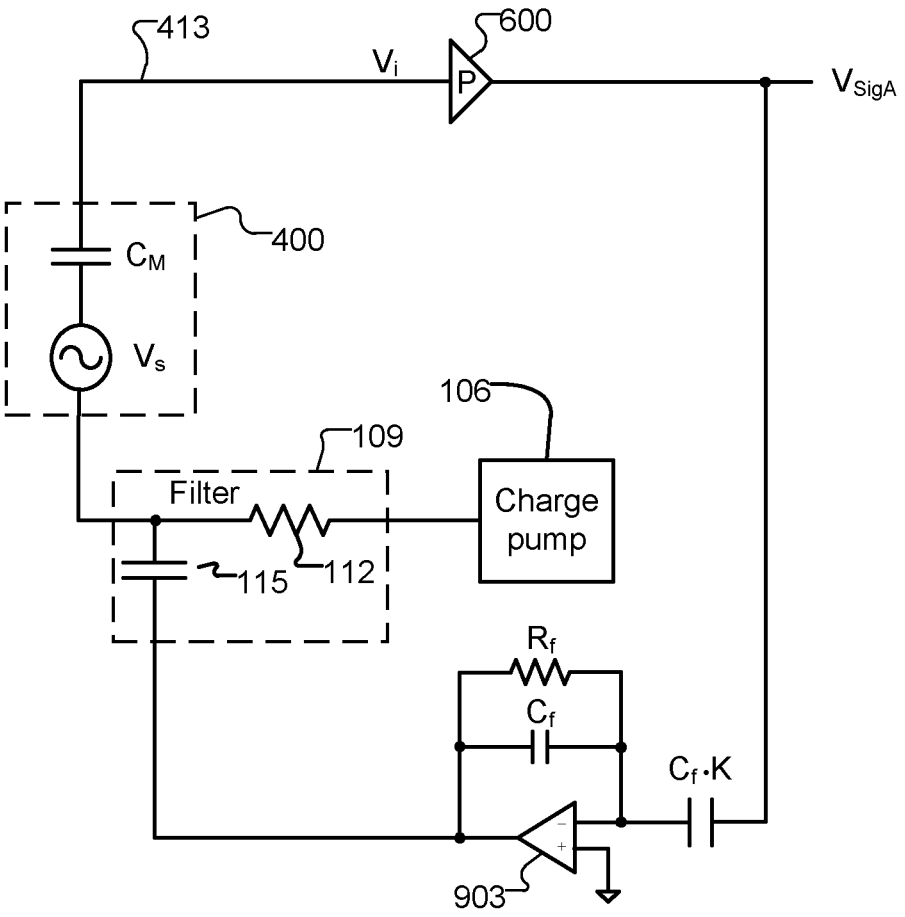
FIG. 9 is a schematic circuit diagram of a MEMS microphone system, with a negative feedback circuit coupled thereto, according to yet another embodiment of the present invention.

FIG. 9 contains a schematic circuit diagram of another exemplary embodiment, in this case one that includes a high-pass filter in the feedback loop. A buffer 900 has a gain of P, and amplifier circuitry has a gain of K. The transfer function of the feedback loop is as shown in equation (13).

$$H(s) = \frac{S \cdot R_f \cdot C_f}{1 + S \cdot R_f \cdot C_f} \tag{13}$$

Figure 10:
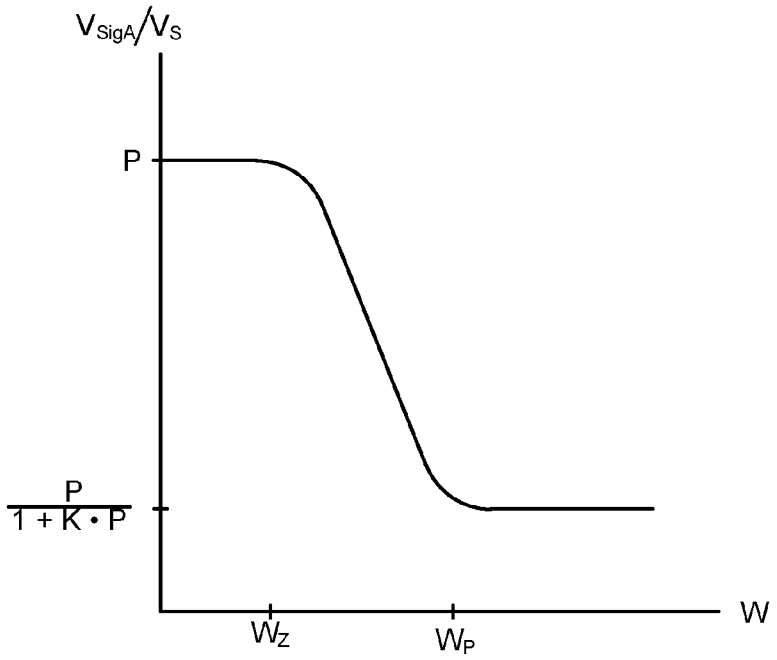
FIGS. 10 and 11 are plots of transfer functions of the circuit of FIG. 9.

The transfer function of $V_{SigA}$, which is a low-pass filter function, is as shown in equation (14) and in a plot in FIG. 10.

$$V_{SigA} = \frac{P \cdot (1 + S \cdot R_f \cdot C_f)}{1 + S \cdot R_f \cdot C_f \cdot (1 + K \cdot P)} \cdot V_s \tag{14}$$

where $$W_p\text{: Pole: } S = \frac{1}{R_f \cdot C_f (1 + K \cdot P)} \tag{15}$$

$$W_z\text{: Zero: } S = \frac{1}{R_f \cdot C_f} \tag{16}$$

Figure 11:
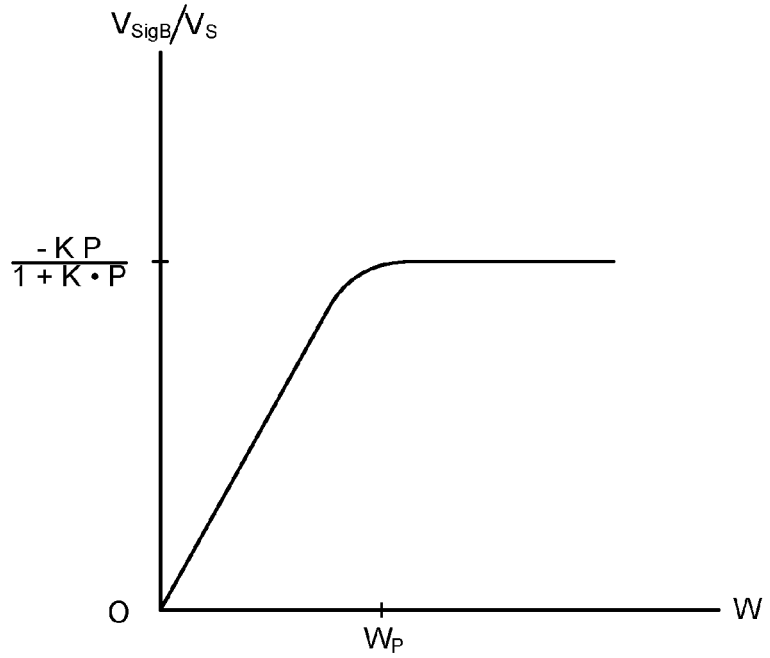

The transfer function of $V_{SigB}$, which is a high-pass filter function, is as shown in equation (17) and in a plot in FIG. 11.

$$V_{SigB} = \frac{-S \cdot K \cdot P \cdot R_f \cdot C_f)}{1 + S \cdot R_f \cdot C_f \cdot (1 + K \cdot P)} \cdot V_s \tag{17}$$

where $$W_p\text{: Pole: } S = \frac{1}{R_f \cdot C_f (1 + K \cdot P)} \tag{18}$$

$$W_z\text{: Zero: } S = 0 \tag{19}$$

Various values of K, such as values greater than 1 or less than 1, and different values of P, such as greater or less than 1 (even less than 0), may be used in appropriate situations. Similarly, various values of H(s) and F(s) may be used. Those skilled in the art should recognize that these and other values may be selected to optimize or alter operation of the circuits shown herein for various needs.

Figure 26:
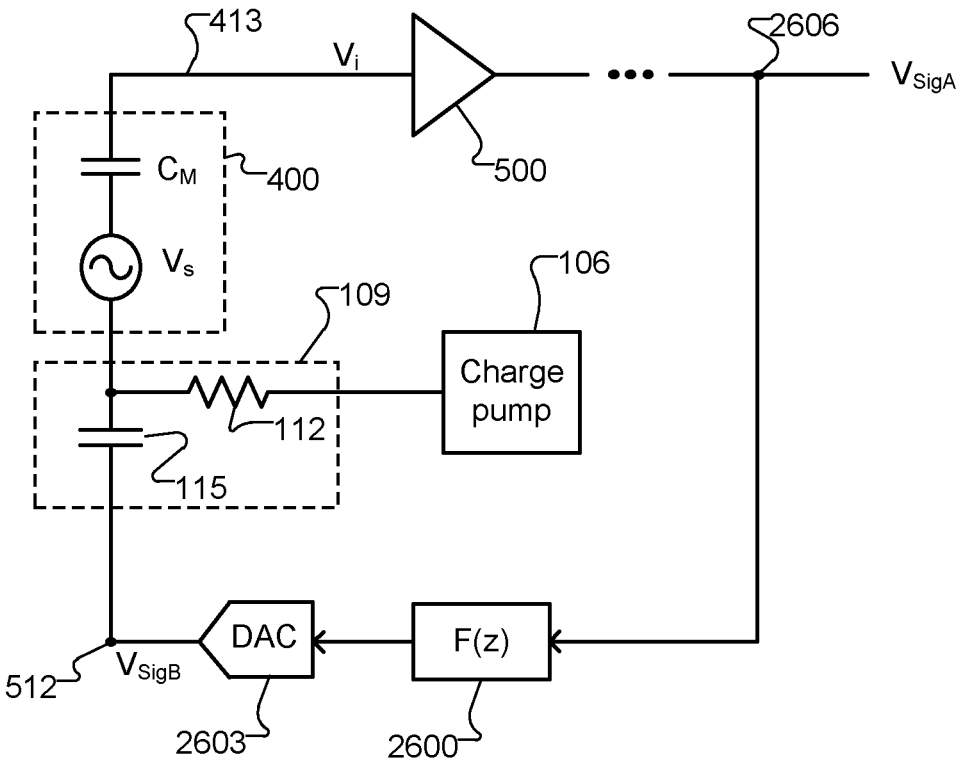
FIG. 26 is a schematic circuit diagram of a MEMS microphone system, similar to the circuit of FIG. 5, with several components replaced by digital circuits, according to an embodiment of the present invention.

Returning to FIG. 5, the node 509 may be coupled directly to the output of the buffer 500, or other signal processing circuits, such as amplifiers, analog-to-digital converters, digital signal processors, digital-to-analog converters, etc. (not shown) may replace, or be interposed between, the buffer 500 and the node 509. Nevertheless, the node 509 is referred to herein as being a node "downstream" of the buffer 500. The filter 506 and/or the amplifier 503 may be replaced by digital circuits, as shown in FIG. 26. Here, a signal processor 2600 and a digital-to-analog converter 2603 process the signal from node 2606 to generate the corrective signal $V_{sigB}$, which is applied to the terminal of the capacitor 115 that would otherwise be grounded.

Implementation: Controlled Impedance on Signal Line from Condenser Microphone Adding capacitance to a line carrying a signal from a MEMS microphone element is counterintuitive. Conventionally, capacitance along such a line is considered parasitic, because it attenuates the already weak signal from the MEMS microphone element. The capacitance of a typical MEMS microphone element is on the order of about 1-2 pF. Consequently, not much (on the order of about tens or hundreds of fF) parasitic capacitance is sufficient to attenuate a significant fraction of the signal. Thus, prior art MEMS microphone circuits are designed to minimize parasitic capacitance, not to purposefully add capacitance to a MEMS microphone signal line.

However, according to some embodiments of the present invention, a capacitor is purposefully coupled to a line carrying a MEMS microphone signal to attenuate the signal or control the effective frequency response of the MEMS microphone element. The effective capacitance of the capacitor may be dynamically and automatically varied, thereby dynamically and automatically varying an amount by which the signal from the MEMS microphone element is attenuated.

The signal 301, (FIG. 3) which influences the effective capacitance of $C_D$, may be based on an automatic frequency (and/or, if desired, amplitude) analysis of the signal from the condenser microphone element. "Analysis" here means detecting the presence of one or more frequency components in a signal and/or detection of amplitude of a signal or a signal component that meets or exceeds a threshold. That is, the effective value of the capacitor $C_D$, over the range of undesired frequencies or amplitudes, may be automatically adjusted according to amplitude or presence of one or more, or a range of, unwanted frequencies in the signal from the condenser microphone element. In response to detecting unwanted frequencies in the signal from the condenser microphone (such as high-amplitude low-frequencies of wind buffets), the effective value of the capacitor $C_D$ may be increased. On the other hand, in response to detecting only wanted frequencies, the effective value of the capacitor $C_D$ may be decreased to a non-zero value or to zero.

Thus, the signal from the condenser microphone element is selectively attenuated, based on presence or amplitude of an unwanted frequency in the signal. Consequently, unwanted frequency components of the signal are attenuated, and desired frequency components are left unattenuated. As a result, a signal processing circuit coupled to the condenser microphone element, or downstream circuits, are not overwhelmed by the amplitude of the unwanted frequencies.

Figure 12:
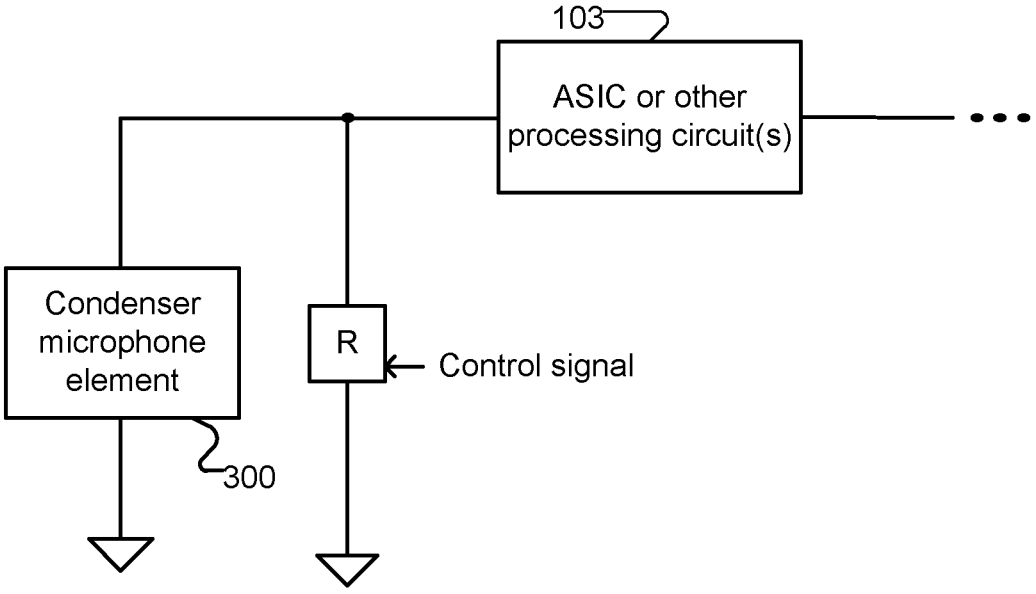
FIG. 12 is a schematic circuit diagram of a model of a condenser microphone, with a controlled attenuating impedance coupled thereto, according to an embodiment of the present invention.

In some embodiments, as shown schematically in FIG. 12, a controllable impedance R is coupled to the condenser microphone element. Capacitance (C) of the condenser microphone element and the controllable impedance (R) form a high-pass filter. The filter may be active all the time, or the filter may be automatically selectively activated in response to detection or amplitude of unwanted frequencies in the signal from the condenser microphone element. The controllable impedance may be implemented with switched capacitors.

The high-pass corner of a circuit coupled to (or including) the condenser microphone element may be automatically tuned in response to automatically measured characteristics of the circuit and/or signals present in the circuit. Optionally or alternatively, the high-pass corner may be tuned in response to a user input.

Figure 13:
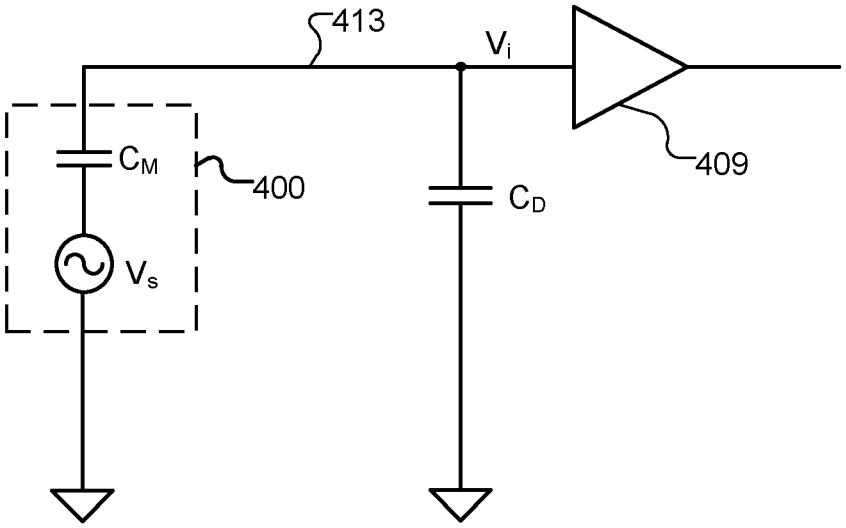
FIG. 13 is a schematic circuit diagram of a model of a condenser microphone, with an attenuating capacitor coupled thereto, according to an embodiment of the present invention.

Returning to the model of the condenser microphone, as shown in FIG. 13, if one terminal of a capacitance $C_D$ is coupled to the signal line 413, and the other terminal of the capacitance $C_D$ is connected to an appropriate AC signal ground, the signal $V_i$ available at the input to the buffer 409 is attenuated according to equation (20).

$$V_i \approx \frac{C_M}{C_M + C_D} \cdot V_s \tag{20}$$

For example, if $C_D=C_M$, the signal from the condenser microphone element 100 is attenuated by about ½ (i.e., −6 dB). If $C_D=10*C_M$, the attenuation is 6.5 times greater than if $C_D=C_M$.

Figure 14:
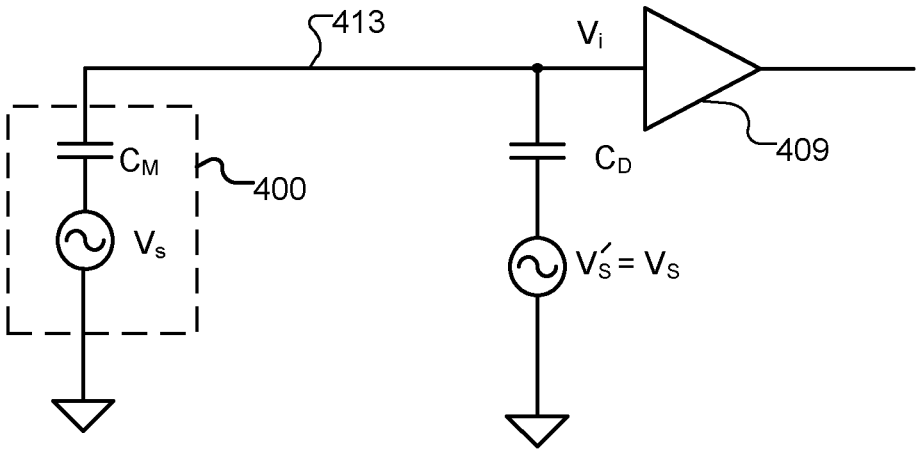
FIG. 14 is a schematic circuit diagram of the model of the MEMS microphone and attenuating capacitor, similar to the circuit of FIG. 13, with a signal source (comparable in amplitude to a signal from the MEMS microphone) coupled to the capacitor, according to an embodiment of the present invention.

However, as shown in FIG. 14, if a signal $V_s'$, which is equal to the signal $V_S$, is applied to the bottom terminal of the capacitor $C_D$, both terminals of the capacitor see essentially equal voltages. That is, $V_S$ is applied to one terminal of the capacitor $C_D$, and equal $V_s'$ is applied to the other terminal of the capacitor $C_D$. A capacitor with equal voltages applied to both its terminals is effectively made nonexistent. Therefore, the capacitor $C_D$ effectively is absent from the circuit, and $V_i$ is not attenuated. Consequently, $V_i \approx V_S$.

In general, for the circuit shown in FIG. 14, the signal $V_i$ available at the input to the buffer 409 can be calculated according to equation (21).

$$V_i = \frac{V_s \cdot C_M + V_s' \cdot C_D}{C_M + C_D} \tag{21}$$

For the special case where $V_s=V_s'$, we find that $V_i=V_s$.

Thus, an amount by which the signal $V_i$ is attenuated by the capacitor $C_D$ can be controlled by selectively grounding (as shown in FIG. 13) or applying a signal $V_s'$ (as shown in FIG. 14) to the bottom terminal of the capacitor $C_D$.

Figure 15:
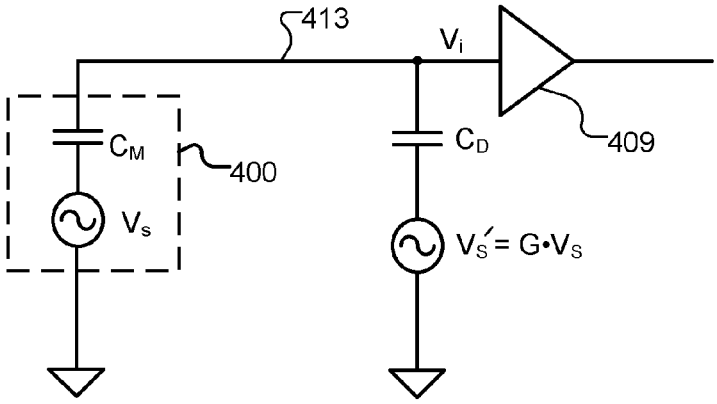
FIG. 15 is a schematic circuit diagram of the model of FIG. 14, in which the signal coupled to the capacitor is other than comparable in amplitude (and phase, if $K<0$) to the signal from the MEMS microphone.

A special case where $V_s'=G \cdot V_s$ is shown in FIG. 15. In this case, the signal $V_i$ available at the input to the buffer 409 is attenuated according to equation (22).

$$V_i \approx \frac{C_M + G \cdot C_D}{C_M + C_D} \cdot V_s \tag{22}$$

In this case, $V_s'<V_s$, so $-\infty<G<1$. It should be noted that the circuit shown in FIG. 13 is a special case of the circuit shown in FIG. 15 where G=0, and the circuit shown in FIG. 14 is a special case of the circuit of FIG. 15 where G=1. Furthermore, if $$G = -\frac{C_M}{C_D},$$

then $V_i \approx 0$, i.e., the input signal from the MEMS microphone element 100 is essentially cancelled.

Thus, if a single frequency or a range of frequencies represents solely or mostly unwanted signals, ideally $$G = -\frac{C_M}{C_D}$$

for those frequencies, and G=1 for other (wanted) frequencies. However, it may not be necessary to fully cancel the input signal at unwanted frequencies. It may be sufficient to merely attenuate the input signal, as long as the signal processing circuits can handle the resulting amplitudes. Thus, for example, if $C_D=10*C_M$ and G=0, $V_i \approx 0.09 \cdot V_s$. If G=0.1, $V_i \approx 0.18 \cdot V_s$. These attenuations may be sufficient, depending on expected amplitudes of unwanted frequencies and "headroom" of the signal processing circuits.

Figure 3:
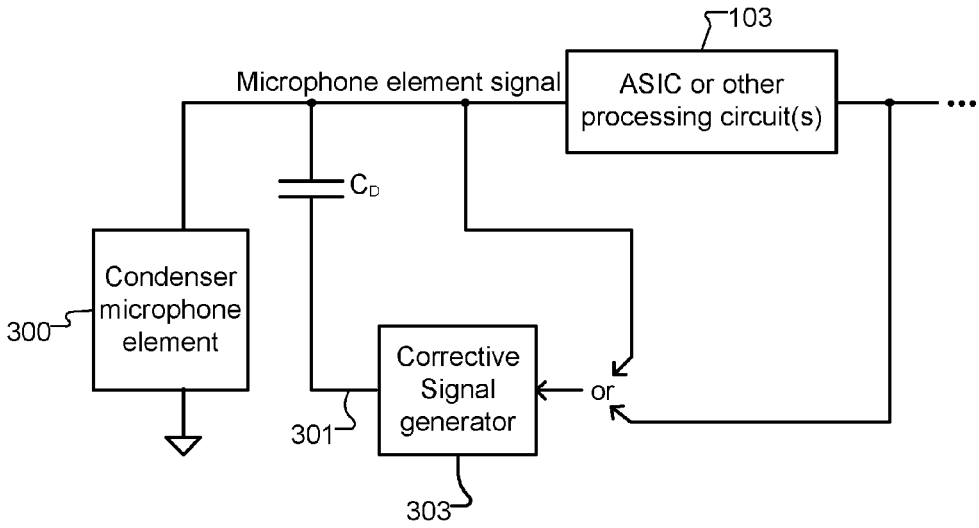
FIG. 3 is a schematic block diagram of a condenser microphone system, according to another approach provided by the present invention.

In general, the corrective signal generator 303 shown in FIG. 3, or another circuit, generates an appropriate corrective signal 303 to make the capacitor $C_D$ behave in a way that attenuates the signal from the MEMS microphone element as desired. Various exemplary embodiments will now be described.

Implementations

Figure 16:
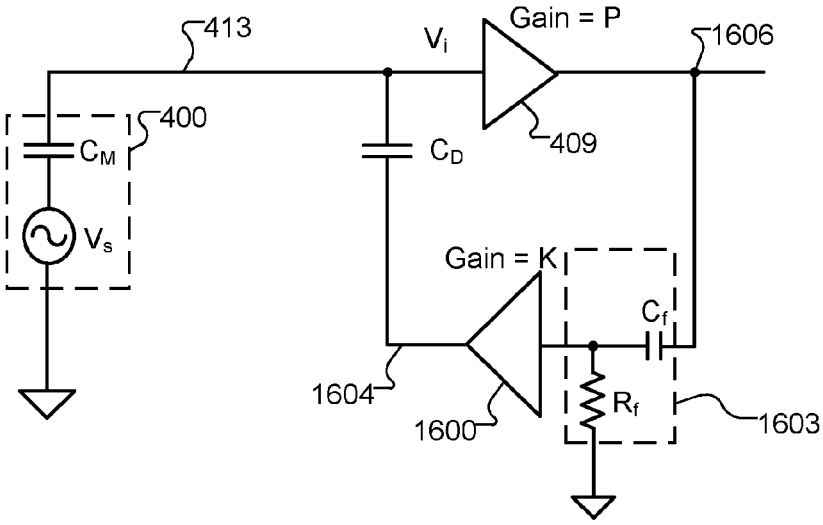
FIG. 16 is a schematic circuit diagram of an automatic signal attenuator, with a passive RC filter, according to an embodiment of the present invention.

FIG. 16 is a schematic circuit diagram of an embodiment of the present invention. The embodiment shown in FIG. 16 is based on the model shown in FIG. 15. An amplifier 1600 and a filter 1603 are used to generate a corrective signal 1604 to apply to the bottom terminal of the capacitor $C_D$. The filter 1603 may be a simple first-order high-pass filter that takes as its input a signal from a node 1606 that is downstream of the buffer 409.

The node 1606 may be coupled directly to the output of the buffer 409 (as shown in FIG. 16), or other signal processing circuits (such as amplifiers, analog-to-digital converters, digital signal processors, digital-to-analog converters, etc., not shown) may replace, or be interposed between, the buffer 409 and the node 1606. Nevertheless, the node 1606 is referred to herein as being a node "downstream" of the buffer 409. The buffer 409 (and possibly, but not necessarily, additional signal processing circuits between the output of the buffer 409 and the node 1606) is referred to herein as a circuit having an input coupled to the MEMS microphone 400 to receive an electrical signal that varies in accordance with the variable capacitance of the MEMS microphone 400 and outputs a corresponding processed electrical signal. Note that the buffer 409 can have any gain P and may optionally implement a filter function F(s), and buffer 1600 can have gain K, where P*K<1.

The high-frequency corner of the filter 1603 is calculated according to the well-known formula shown in equation (23).

$$f_{3db} = \frac{1}{2\pi R_f C_f} \tag{23}$$

For frequencies much greater than $f_{3db}$, the high-pass filter 1603 passes the signal from node 1606 to the amplifier 1600. Assuming the amplifier 1600 has a gain of 1 and the buffer 409 has a gain of 1, the amplitude of the signals applied to both sides of the capacitor $C_D$ are approximately equal, for frequencies much greater than $f_{3db}$. Therefore, G≈1, and the capacitor $C_D$ is effectively removed from the circuit, thereby making $V_i \approx V_s$.

However, for frequencies much less than $f_{3db}$, the high-pass filter 1603 passes little or none of the signal from node 1606 to the amplifier 1600. No signal at the input to the amplifier 1600 translates into no signal at the output of the amplifier 1600. No signal output from the amplifier 1600 is equivalent to the amplifier having a gain of zero (G≈0), which causes the bottom terminal of the capacitor $C_D$ to be effectively grounded or nearly so. Therefore, the capacitor $C_D$ effectively forms an impedance divider with the MEMS microphone capacitance $C_M$, thereby attenuating the signal $V_i$ making $$V_i \approx \frac{C_M}{C_M + C_D} \cdot V_s,$$

according to equation (20).

The high-frequency corner frequency ($f_{3db}$) may be selected, based on frequencies that are deemed unwanted or characteristic of unwanted signals. Selecting values of $R_f$ and $C_f$ to achieve the desired $f_{3db}$ (according to equation (23)) is within the capabilities of one skilled in the art.

As noted with reference to FIG. 13, high values of attenuation may be achieved by making $C_D >> C_M$. As noted with reference to FIG. 15, the attenuation effect of the capacitor $C_D$ can be multiplied by using an inverting amplifier 1600. Using an amplifier with an absolute gain larger than 1 can save real estate in the resulting die, because the capacitor $C_D$ need not be as physically large.

Thus, if a frequency much greater than $f_{3db}$ is present in the signal from the downstream node 1606, the circuit in FIG. 16 effectively couples an impedance (capacitor $C_D$) to the input of the buffer 409 to attenuate the signal 413. However, if no such frequency is present in the downstream signal, the capacitor $C_D$ is effectively removed from the circuit, and the signal 413 is not attenuated. Thus, whether the capacitor $C_D$ is effectively coupled or removed from the circuit depends on a frequency-dependent criterion, i.e., whether a frequency much greater than $f_{3db}$ is present in the downstream signal.

Collectively, the amplifier 1600 and the filter 1603 form a circuit configured to effectively couple the impedance (capacitor $C_D$) to the input of the buffer 409 in response to automatic detection that the downstream node 1606 signal includes a frequency much greater than $f_{3db}$, (i.e., meets a frequency-dependent criterion), wherein the impedance (capacitor $C_D$) is configured to attenuate the electrical signal ($V_i$) received at the input of the buffer 409, and effectively remove the impedance (capacitor $C_D$) from the input of the buffer 409 when the downstream signal does not meet the frequency-dependent criterion.

Figure 17:
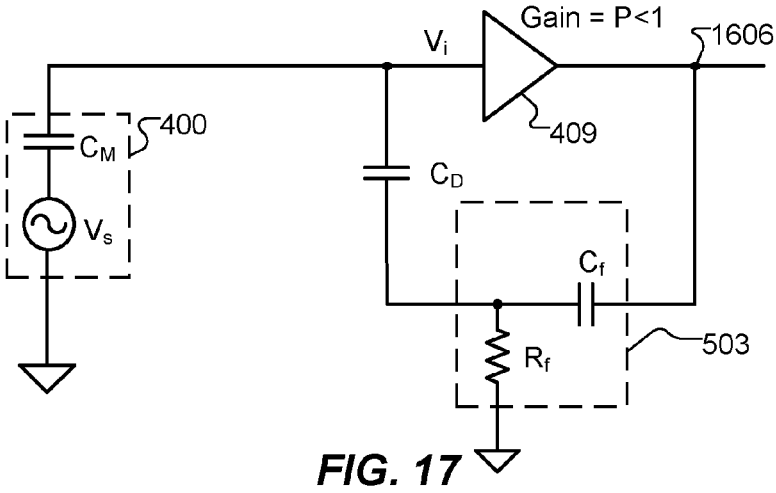
FIG. 17 is a schematic circuit diagram of an automatic signal attenuator, with a different passive RC filter, according to an embodiment of the present invention.

Under certain constraints, such as $C_f > C_D$, the circuit of FIG. 16 can be simplified, as shown in FIG. 17. The larger the value of $C_f$, compared to the value of $C_D$, the less $C_D$ influences frequency response of the loop from node 1606, through the filter 1603, to the capacitor $C_D$.

Figure 18:
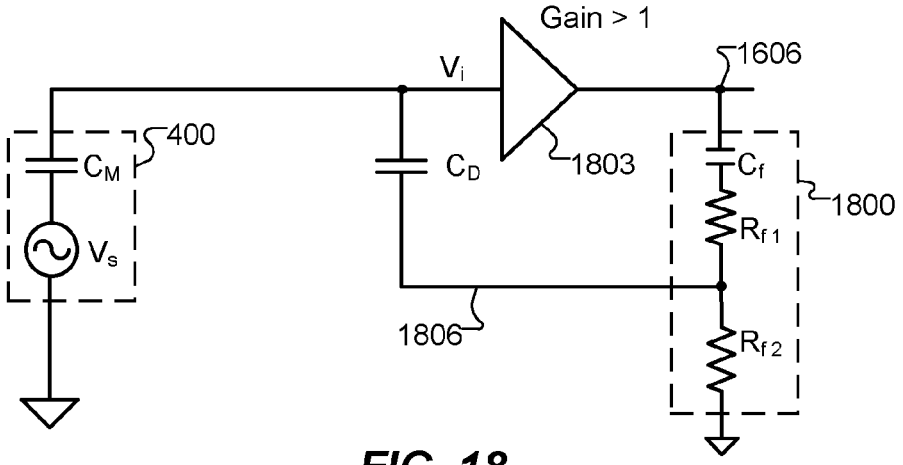
FIG. 18 is a schematic circuit diagram of an automatic signal attenuator, with a buffer/amplifier having a gain greater than 1, and a divider network, according to an embodiment of the present invention.

The circuit shown in FIG. 18 is a special case of the circuit of FIG. 17, in which the buffer/amplifier 1803 provides gain larger than 1. The attenuation is approximately equal to the gain of the buffer/amplifier 1803. $C_f$ passes wanted high frequencies, so the output of the buffer/amplifier 1803 is provided to the top of a divider network formed by $R_{f1}$ and $R_{f2}$. The output 1806 of the divider network $R_{f1}$ and $R_{f2}$ should be the inverse of the gain P of the buffer/amplifier 1803, such that a signal representing effectively G≈1 is applied to the bottom terminal of the capacitor $C_D$. Thus, if the buffer/amplifier 1803 gain is P, then the attenuation provided by the divider network $R_{f1}$ and $R_{f2}$, shown in equation (24), $$\text{Attenuation} = \frac{R_{f_2}}{R_{f_1} + R_{f_2}} \tag{24}$$

should be 1/P. At wanted high frequencies, the circuit feeds approximately 1× the signal $V_i$ to the bottom terminal of the capacitor $C_D$, effectively removing the capacitor $C_D$ from the circuit.

Sharper transitions between attenuated signals and unattenuated signals may be desirable when, for example, the boundary frequency of the unwanted signal is well defined. In these cases, higher order filters may be used. A sharper filter and negative feedback may be used to obtain a sharper transition and increased attenuation of unwanted signals, as shown schematically in FIG. 17. Note that an amplifier 1900 is used in the feedback loop.

Lower (unwanted) frequencies $$\left(f < \frac{1}{2\pi R_f C_f}\right)$$

are blocked by the filter 1903 and, therefore, are applied to only the inverting input of the amplifier 1900. The inverted and amplified (by the ratio $R_2/R_1$) lower frequencies are applied to the capacitor $C_D$ to multiply the effective capacitance of the capacitor $C_D$ and, therefore, multiply the attenuation of these unwanted frequencies. On the other hand, the filter 1903 passes higher (wanted) frequencies to the non-inverting input of the amplifier 1900. The non-inverted higher frequencies are applied to the capacitor $C_D$, thereby effectively removing the capacitor $C_D$ from the circuit, as far as the high frequencies are concerned. Consequently, only the unwanted frequencies are attenuated before reaching the buffer 409.

Figure 20:
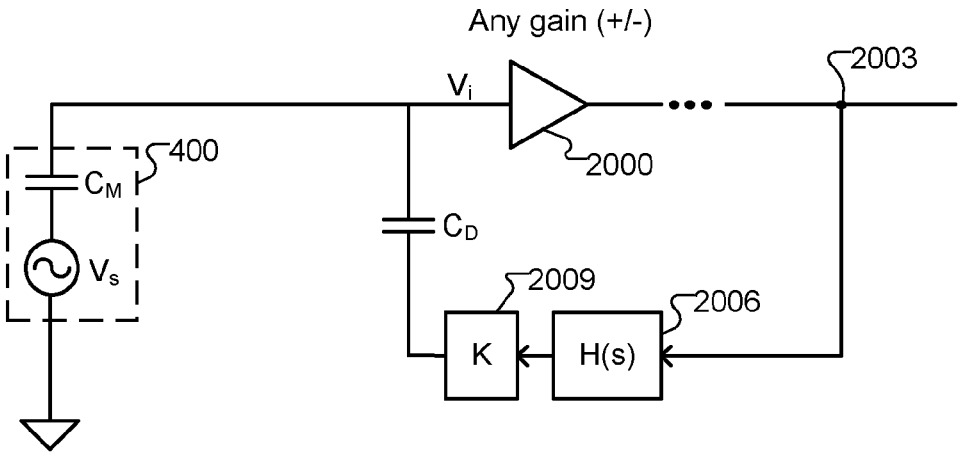
FIG. 20 is a schematic circuit diagram of a generalized automatic signal attenuator, according to an embodiment of the present invention.

FIG. 20 is a generalized schematic circuit diagram of some embodiments of the present invention. The buffer/amplifier 2000 can provide any gain, including positive and negative gains. The buffer/amplifier 2000 may have a differential output. As noted, the buffer/amplifier 2000 may be implemented with analog, digital or hybrid circuits. A sample of the signal may be taken anywhere 2003 downstream of the buffer/amplifier 2000. A filter block 2006 and amplifier 2009 process the signal from the node 2003 to select frequencies that are to be attenuated. Output of the filter block 2006 and amplifier 2009 is applied to the bottom terminal of the capacitor $C_D$ to selectively attenuate the signal $V_i$ before it reaches the buffer/amplifier 2000. Effectively, the filter block 2006, amplifier 2009 and the capacitor $C_D$ shape the frequency response of the MEMS microphone system. The amplifier 2009 may provide signal gain or attenuation.

It should be noted that the signal from node 2003 may be analog or digital. Furthermore, more than one node 2003 may be tapped for several signals to be analyzed by the filter block 2006 and amplifier 2009. As shown in the schematic circuit diagram of FIG. 21, the signal path downstream of the buffer/amplifier 2000 may include digital signal processing circuits, such as an analog-to-digital converter (ADC) 2100. Thus, the node 2003 may provide a digital signal. A signal processing circuit 2103 may include analog circuits, digital circuits or a combination thereof. The signal processing circuit 2103, the filter block 2006 (FIG. 20) and amplifier 2009 (FIG. 20), and other components described herein may include, or be controlled by, a processor controlled by instructions stored in a memory. Thus, it is possible to implement some embodiments of the present invention without RC filters. Furthermore, the output of the signal processing block 2103 is digital and may be fed to a digital-to-analog converter (DAC) 2106, and the output of the DAC 2106 may be coupled to the bottom terminal of the capacitor $C_D$.

The filter block 2006 (FIG. 20) or the signal processing block 2103 (FIG. 21) may be thought of as a control circuit that drive the capacitor $C_D$ or a circuit, such as DAC 2106, that drive the capacitor $C_D$.

Figure 19:
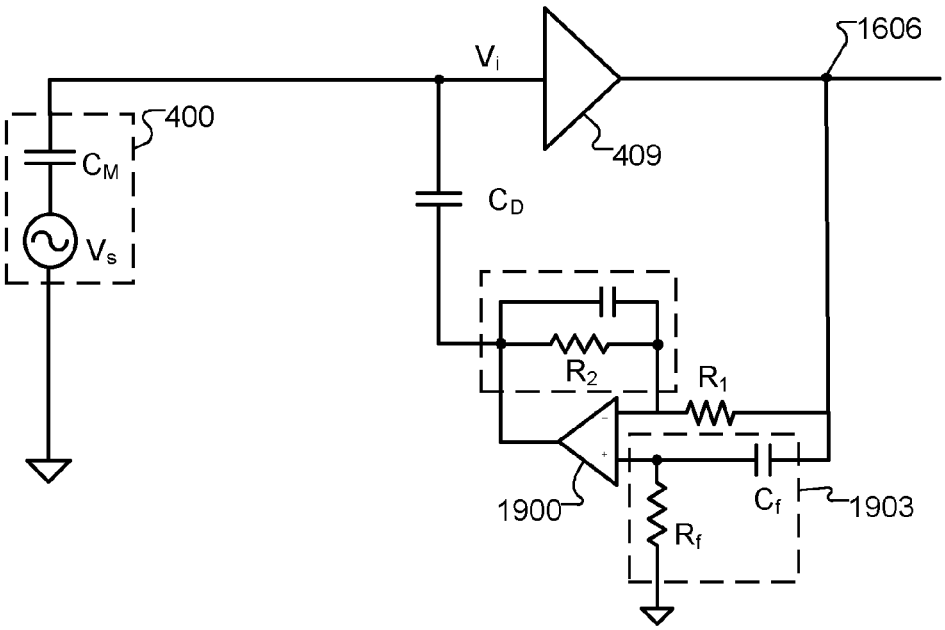
FIG. 19 is a schematic circuit diagram of an automatic signal attenuator, with an amplifier to multiply the effect of the attenuating capacitor, according to an embodiment of the present invention.

To minimize the attenuation of wanted signals by the capacitor $C_D$, the phase lag for desired frequencies of the feedback network (such as signal processing performed downstream of the buffer/amplifier 2000 (FIG. 20) up to the node 2003, the filter block 2006 and amplifier 2009 or the signal processor block 2103 (FIG. 21) and the DAC 2106 or amplifier 1900 (for example, as in FIG. 19), as the case may be) to the capacitor $C_D$ should be minimized. As noted, the same (or similar) signals need to be applied to both terminals of the capacitor $C_D$ to effectively remove the capacitor $C_D$ from the circuit. Phase differences between the signals applied to the two terminals of the capacitor $C_D$ can diminish effectiveness of the circuit. On the other hand, if when providing negative feedback to the capacitor $C_D$, a signal that is 180° out of phase may be advantageously used to attenuate the input.

Rather than leaving the capacitor $C_D$ connected to the signal path 2109 (FIG. 21) leading to the buffer/amplifier 2000 all the time, the capacitor $C_D$ may be coupled to the signal path 2109 via a switch 2113, such as a FET or any suitable switch. The switch 2113 may be controlled 2116 by the signal processor block 2103 or by a separate controller (not shown). Thus, the capacitor $C_D$ may be automatically switched into the signal path 2109 when needed to attenuate signals, and the capacitor $C_D$ may be automatically disconnected from the signal path 2109 when it is not needed to attenuate signals. Disconnecting the capacitor $C_D$ from the signal path 2109 when it is not needed for attenuation reduces overall system noise. The capacitor $C_D$ may be switched into and out of the signal path 2109 at zero-crossings of the signal $V_i$, or as close to zero-crossings as practical. The switching need not, however, be fast. Occasionally, clipping a few cycles of the signal $V_i$ may be acceptable. Thus, as long as the state of the switch 2113 can change in less than a few cycles of the signal to be attenuated, switching times may be adequate.

As noted, with respect to FIG. 4, the diodes 403 and 406 are high-impedance devices. The diodes can introduce diode junction noise into the signal line 413. However, most diode junction noise is filtered out due to the capacitance of the MEMS microphone element $C_M$. The filter corner frequency is given by equation (25), $$f = \frac{1}{2\pi R C_M} \tag{25}$$

where R is the impedance of the diodes 403 and 406. The noise spectral density due to this filter is quite high in energy at about 1-2 Hz. However, the noise spectral density drops off after the filter corner and then decreases about 20 dB per decade. Thus, although the diodes generate a significant amount of noise, the noise is at low frequencies, well below the human audible range.

Integrated filters with pole and zeros within the audio band sometimes introduce circuit noise. However, the introduction of such noise may be acceptable, given the attenuation of large amplitude signals and prevention of overloading of ASIC and other circuits provided by embodiments of the present invention.

The resistors of the filters described herein are preferably implemented with switched capacitors to reduce the amount of real estate occupied by the resistors. As those skilled in the art will realize, a ratio of capacitors can be used to implement signal gains instead of a ratio of resistors. This approach may lead to lower noise implementations.

Although in the descriptions of the circuits in FIGS. 3 and 12-21 refer to a capacitor $C_D$ for attenuating a signal, the capacitor $C_D$ need not be a purely capacitive impedance. This impedance $C_D$ can, for example, be implemented with other components, such as resistors, switched capacitor resistors, other components or a combination thereof. Furthermore, several capacitors or other components may be joined together to form the impedance $C_D$. Furthermore, as noted, the buffer/amplifier may have a gain other than 1, as well as a negative gain, and the buffer/amplifier may have a differential output, whose negative output may be used for a feedback path.

High-Pass Filter at Input to Buffer/Amplifier

Figure 22:
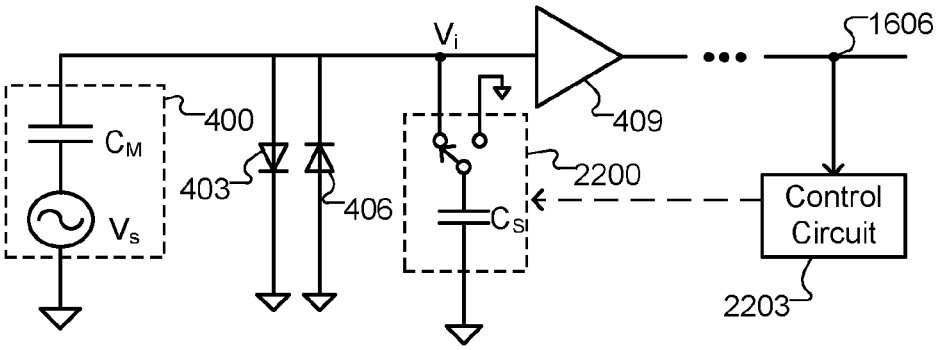
FIG. 22 is a schematic circuit diagram of an automatic signal attenuator, implemented as a high-pass filter, according to an embodiment of the present invention.

Another approach to attenuating unwanted frequencies before they reach a buffer/amplifier involves implementing an automatically-controlled ("programmable") high-pass filter, such as a simple first-order RC filter, at the input to the buffer/amplifier, as shown in FIG. 22. A switched capacitor resistor 2200 and the capacitance $C_M$ of the MEMS microphone element 400 form an RC filter. As noted, the diode impedances are so high, compared to the switch capacitor resistance, that their impedance can be ignored. The effective resistance of the switched capacitor resistor 2200 is given by equation (26), $$R_s = \frac{1}{f_{ck} C_S} \tag{26}$$

where $f_{ck}$ the clock frequency driving the switched capacitor resistor 2200. A control circuit 2203 similar to the control circuits described above, with reference to FIGS. 20 and 21, may be used to determine when the high-pass filter should be activated, as well as the filter corner of the high-pass filter. The filter corner may be controlled by the clock frequency used to drive the switched capacitor resistor.

Figure 23:
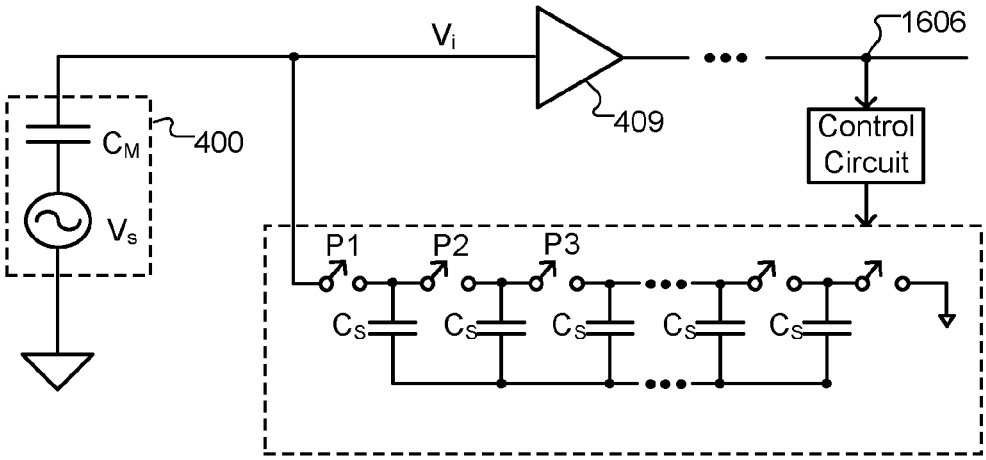
FIG. 23 is a schematic circuit diagram of an automatic signal attenuator, implemented as a high-pass filter, according to another embodiment of the present invention

FIG. 23 is a schematic circuit diagram of another high-pass filter where the switched capacitor resistor is implemented differently than in the circuit of FIG. 22. The switches P1, P2, P3, . . . are operated such that the switch closures do not overlap. Here, the effective resistance of the switched capacitor resistor is given by equation (27), $$R_s = \frac{N}{f_{ck} C_S} \tag{27}$$

where N equals the number of capacitors, and the high-pass corner frequency is given by equation (28).

$$f = \frac{1}{2\pi R_S C_M} \tag{28}$$

Circuits and methods have been described for automatically cancelling or attenuating an electrical signal from a transducer, such as a MEMS or other condenser microphone. As described, these circuits and methods are applicable when the signal may include unwanted frequencies, such as from wind buffets. These circuits and methods may also be used to remove acoustic impulses, such as sounds of door slams. In the case of such an impulse, the diodes 403 and 406 (FIG. 4) may begin conducting, thereby leaking charge from a MEMS microphone element, and thereby changing the DC voltage at the buffer/amplifier input. Typically, a bias circuit replenishes the lost charge. However, it may take some time to replenish the charge. Since such impulses include significant low-frequency components, at least portions of the impulses may be cancelled or attenuated by the circuits and methods described herein, thereby reducing or eliminating the charge-loss problem.

Figure 24:
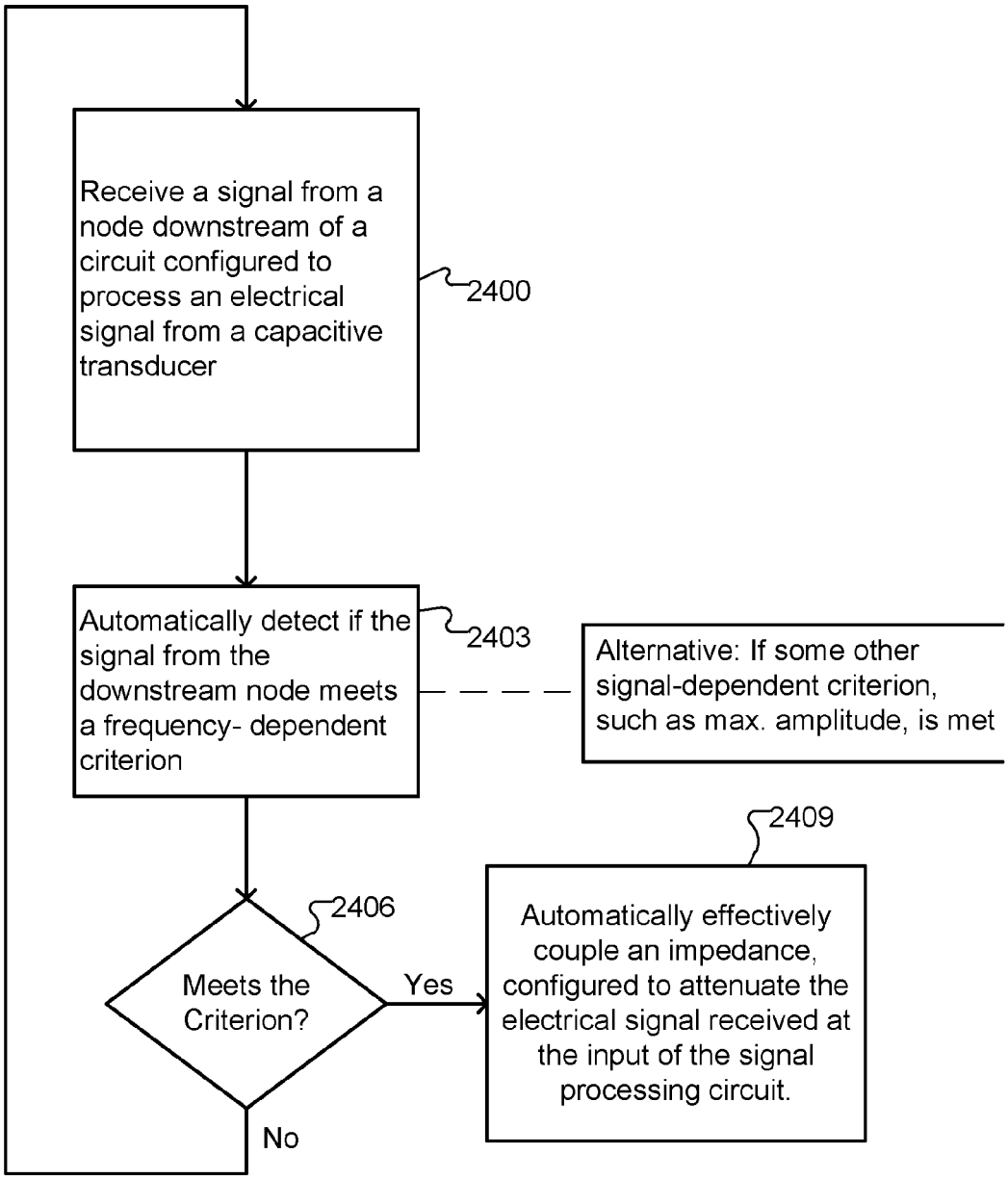
FIG. 24 is a flowchart illustrating operation of an embodiment of the present invention.

FIG. 24 depicts a flowchart illustrating operation of an embodiment of the present invention. At 2400, a signal is received from a node downstream of a circuit configured to process an electrical signal from a capacitive transducer, such as a MEMS microphone. At 2403, it is automatically detected if the signal from the downstream node meets a frequency-dependent criterion. For example, if the signal includes frequency components below a threshold frequency, or if the signal includes frequency components below the threshold frequency and above a threshold amplitude, the criterion may be consider to have been met.

In an alternative embodiment, a criterion other than a frequency-dependent criterion may be used. For example, the criterion may involve amplitude of the electrical signal from the capacitive transducer. In this case, at 2403, it is automatically detected if the signal from the downstream node meets a signal-dependent criterion. For example, if the signal amplitude (such as the total energy in all frequencies in the signal) exceeds a threshold value, the criterion may be consider to have been met.

Figure 21:
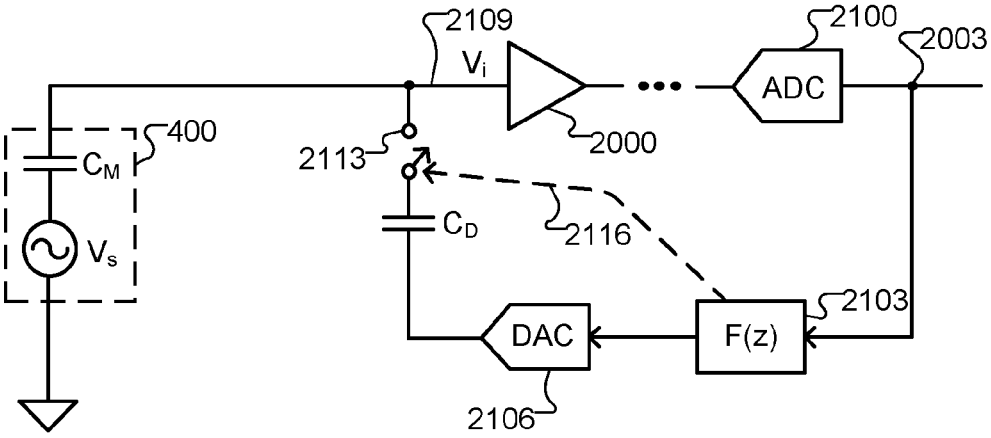
FIG. 21 is a schematic circuit diagram of a generalized automatic digital signal attenuator, according to an embodiment of the present invention.

At 2406, control passes to 2409 if the criterion was met. At 2409, impedance is automatically effectively coupled to the electrical signal received at the input of the signal processing circuit. The impedance is configured to attenuate the electrical signal. Increasing the effective capacitance of the capacitor $C_D$ by applying an appropriate signal $V_s'$ to a terminal of the capacitor, as described herein, is an example of automatically effectively coupling impedance to the electrical signal. Similarly, closing a switch, such as an FET, to connect the capacitor $C_D$ to the signal line, as described with respect to FIG. 21, is an example of automatically effectively coupling an impedance to the electrical signal.

Circuits and methods have been described for automatically attenuating an electrical signal from a transducer, such as a MEMS microphone. Some of these circuits and methods may be implemented by a processor controlled by instructions stored in a memory. The memory may be random access memory (RAM), read-only memory (ROM), flash memory or any other memory, or combination thereof, suitable for storing control software or other instructions and data. Some of the functions performed by the circuits and methods have been described with reference to flowcharts and/or block diagrams. Those skilled in the art should readily appreciate that functions, operations, decisions, etc. of all or a portion of each block, or a combination of blocks, of the flowcharts or block diagrams may be implemented as computer program instructions, software, hardware, firmware or combinations thereof. Those skilled in the art should also readily appreciate that instructions or programs defining the functions of the present invention may be delivered to a processor in many forms, including, but not limited to, information permanently stored on non-transitive non-writable storage media (e.g. read-only memory devices within a computer, such as ROM, or devices readable by a computer I/O attachment, such as CD-ROM or DVD disks), information alterably stored on non-transitive writable storage media (e.g. floppy disks, removable flash memory and hard drives) or information conveyed to a computer through communication media, including wired or wireless computer networks. In addition, while the invention may be embodied in software, the functions necessary to implement the invention may optionally or alternatively be embodied in part or in whole using firmware and/or hardware components, such as combinatorial logic, Application Specific Integrated Circuits (ASICs), Field-Programmable Gate Arrays (FPGAs) or other hardware or some combination of hardware, software and/or firmware components.

While the invention is described through the above-described exemplary embodiments, it will be understood by those of ordinary skill in the art that modifications to, and variations of, the illustrated embodiments may be made without departing from the inventive concepts disclosed herein. For example, although some aspects of circuits and methods have been described with reference to a flowchart, those skilled in the art should readily appreciate that functions, operations, decisions, etc. of all or a portion of each block, or a combination of blocks, of the flowchart may be combined, separated into separate operations or performed in other orders. Furthermore, disclosed aspects, or portions of these aspects, may be combined in ways not listed above. Accordingly, the invention should not be viewed as being limited to the disclosed embodiments.

What is claimed is:

1. A microphone system comprising:

a transducer including a vibratable structure configured to establish a capacitance that varies in accordance with an acoustic signal received by the transducer;

a first circuit having an input coupled to the transducer to receive, via the input, an electrical signal that varies in accordance with the variable capacitance of the transducer, the first circuit having an output and being configured to process the received electrical signal and provide a corresponding processed electrical signal at the output; and a second circuit coupled to the input of the first circuit and to a node downstream of the output of the first circuit, the second circuit comprising a buffer and a filter, and being configured to automatically detect when a signal from the downstream node meets a predetermined criterion and, in response, effectively couple an impedance to the input of the first circuit in response, the filter and the buffer being collectively coupled between the downstream node and the second terminal of the capacitor, so as to provide a filtered and buffered version of the signal from the downstream node to the second terminal of the capacitor, the impedance comprising a capacitor, the capacitor including first and second terminals, the first terminal of the capacitor being coupled to the input of the first circuit, wherein the impedance is configured to attenuate the electrical signal received at the input of the first circuit.

2. A microphone system according to claim 1, wherein the predetermined criterion comprises a frequency-dependent criterion.

3. A microphone system according to claim 1, wherein the predetermined criterion comprises an amplitude-dependent criterion.

4. A microphone system according to claim 1, wherein the impedance comprises a capacitor.

5. A microphone system according to claim 1, wherein:

the predetermined criterion comprises a frequency-dependent criterion;

the impedance comprises a capacitor;

the capacitor includes first and second terminals;

the first terminal of the capacitor is coupled to the input of the first circuit; and the filter is coupled between the downstream node and the second terminal of the capacitor.

6. A microphone system according to claim 1, wherein the filter comprises a high-pass filter, so as to provide a high-pass filtered and buffered version of the signal from the downstream node to the second terminal of the capacitor.

7. A microphone system according to claim 1, wherein:

the filter comprises a digital signal processor; and the buffer comprises a digital-to-analog converter.

8. A microphone system according to claim 1, wherein the buffer is configured to provide a gain having an absolute value greater than 1.

9. A microphone system according to claim 1, wherein the impedance comprises a resistor.

10. A microphone system according to claim 9, wherein the resistor comprises a switched capacitor.

11. A microphone system according to claim 9, wherein the resistor comprises an array of switched capacitors.

12. A microphone system according to claim 1, wherein the second circuit is configured to effectively remove the impedance from the input of the first circuit in response to automatic detection that the signal from the downstream node does not meet the predetermined criterion.

13. A microphone system according to claim 1, wherein the second circuit is configured to effectively couple the impedance to the input of the first circuit at approximately a zero crossing of the electrical signal received at the input of the first circuit.

14. A microphone system according to claim 1, wherein the predetermined criterion is met if the signal from the downstream node contains a predetermined frequency above a predetermined energy level.

15. A microphone system according to claim 1, wherein the predetermined criterion is met if the signal from the downstream node contains a frequency component above a predetermined energy level, below a predetermined frequency.

16. A microphone system according to claim 1, wherein the predetermined criterion is met if total energy in a predefined bandwidth of the signal from the downstream node exceeds a predetermined level.

17. A microphone system according to claim 1, wherein the predetermined criterion is met if total energy of the signal from the downstream node exceeds a predetermined level.

18. A microphone system according to claim 1, wherein the predetermined criterion is met if the signal from the downstream node contains a predetermined frequency component having at least a predetermined amplitude.

19. A microphone system according to claim 1, wherein the predetermined criterion is automatically adjusted.

20. A microphone system according to claim 1, wherein the predetermined criterion is adjustable in response to a user input.

21. A microphone system according to claim 1, wherein the transducer comprises a MEMS microphone.

22. A microphone system according to claim 21, wherein the MEMS microphone, the first circuit and the second circuit are disposed within a single integrated circuit housing.

23. A microphone system according to claim 1, further comprising:

a bias circuit coupled to the transducer;

a third circuit configured to:

automatically generate a corrective signal in response to detection that the electrical signal that varies in accordance with the variable capacitance of the transducer meets a second predetermined criterion; and apply the corrective signal to the bias circuit, such that the corrective signal cancels an unwanted portion of the electrical signal that varies in accordance with the variable capacitance of the transducer.

24. A microphone system according to claim 23, wherein the transducer comprises a MEMS microphone.

25. A microphone system according to claim 24, wherein the MEMS microphone, the bias circuit, the first circuit, the second circuit and the third circuit are disposed within a single integrated circuit housing.

26. A method for automatically attenuating an electrical signal from a transducer, the transducer including a vibratable structure configured to establish a capacitance that varies in accordance with an acoustic signal received by the transducer, a first circuit having an input coupled to the transducer to receive, via the input, an electrical signal that varies in accordance with the variable capacitance of the transducer, the first circuit having an output and being configured to process the received electrical signal and provide a corresponding processed electrical signal at the output, the method comprising:

receiving a signal from a node downstream of the output of the first circuit;

automatically detecting if the signal from the downstream node meets a predetermined criterion; and if the signal from the downstream node meets the predetermined criterion, automatically effectively coupling an impedance, configured to attenuate the electrical signal received at the input of the first circuit, to the input of the first circuit;

automatically detecting if the signal from the downstream node meets the predetermined criterion comprising filtering the signal received from the node downstream of the first circuit to generate a filtered signal; and effectively coupling the impedance to the input of the first circuit comprises:

coupling a first terminal of a capacitor to the input of the first circuit; and applying the filtered signal to a second terminal of the capacitor.

27. A method according to claim 26, wherein detecting if the signal from the downstream node meets the predetermined criterion comprises automatically detecting if the signal from the downstream node meets a frequency-dependent criterion.

28. A method according to claim 26, wherein detecting if the signal from the downstream node meets the predetermined criterion comprises automatically detecting if the signal from the downstream node meets an amplitude-dependent criterion.

29. A method according to claim 26, wherein effectively coupling the impedance comprises coupling a capacitor to the input of the first circuit.

30. A method according to claim 26, wherein:

automatically detecting if the signal from the downstream node meets the predetermined criterion comprises buffering the signal received from the node downstream of the first circuit to generate a filtered buffered signal; and effectively coupling the impedance to the input of the first circuit comprises:

coupling a first terminal of a capacitor to the input of the first circuit; and applying the filtered buffered signal to a second terminal of the capacitor.

31. A method according to claim 26, wherein effectively coupling the impedance to the input of the first circuit comprises effectively coupling a resistor to the input of the first circuit.

32. A method according to claim 31, wherein the resistor comprises a switched capacitor.

33. A method according to claim 31, wherein the resistor comprises an array of switched capacitors.

34. A method according to claim 26, further comprising:

if the signal from the downstream node does not meet the predetermined criterion, automatically effectively removing the impedance from the input of the first circuit.

35. A method according to claim 26, wherein automatically detecting if the signal from the downstream node meets the predetermined criterion comprises automatically detecting if the signal from the downstream node contains a predetermined frequency.

36. A method according to claim 26, wherein automatically detecting if the signal from the downstream node meets the predetermined criterion comprises automatically detecting if the signal from the downstream node contains a frequency component below a predetermined frequency.

37. A method according to claim 26, wherein automatically detecting if the signal from the downstream node meets the predetermined criterion comprises automatically detecting if the signal from the downstream node contains a predetermined frequency component having at least a predetermined amplitude.

38. A method according to claim 26, further comprising automatically adjusting the predetermined criterion.

39. A method according to claim 26, further comprising adjusting the predetermined criterion in response to a user input.

40. A microphone system comprising:

a transducer including first and second terminals and a vibratable structure configured to establish a capacitance that varies in accordance with an acoustic signal received by the transducer, the variable capacitance being detectable between the first and second terminals;

a bias circuit coupled to the second terminal of the transducer;

a first circuit having an input coupled to the first terminal of the transducer to receive, via the input, an electrical signal that varies in accordance with the variable capacitance of the transducer, the first circuit having an output and being configured to process the received electrical signal and provide a corresponding processed electrical signal at the output; and a second circuit comprising a filter and an amplifier and being configured to generate the corrective signal as a low-pass filtered and inverted version of the electrical signal that varies in accordance with the variable capacitance of the transducer, the second circuit configured to:

automatically generate a corrective signal in response to detection that the electrical signal that varies in accordance with the variable capacitance of the transducer meets a predetermined criterion; and apply the corrective signal to the bias circuit, such that the corrective signal cancels an unwanted portion of the electrical signal that varies in accordance with the variable capacitance of the transducer.

41. A microphone system according to claim 40, wherein:

the filter comprises a digital signal processor; and the amplifier comprises a digital-to-analog converter.

42. A microphone system according to claim 40, wherein the predetermined criterion is met if the signal from the electrical signal that varies in accordance with the variable capacitance of the transducer contains more than a predetermined amount of energy within a predetermined frequency range.

43. A microphone system according to claim 40, wherein the predetermined criterion is automatically adjusted.

44. A microphone system according to claim 40, wherein the predetermined criterion is adjustable in response to a user input.

45. A microphone system according to claim 40, wherein the transducer comprises a MEMS microphone.

46. A microphone system according to claim 45, wherein the MEMS microphone, the bias circuit, the first circuit and the second circuit are disposed within a single integrated circuit housing.

* * * * *